United States Patent [19]

Evans

[11] 4,456,404

[45] Jun. 26, 1984

[54] METHOD AND APPARATUS FOR POSITIONING A WORKING BARGE ABOVE A SEA SURFACE

[75] Inventor: Darrell L. Evans, Spring, Tex.

[73] Assignee: Atlantic Pacific Marine Corporation, Houston, Tex.

[21] Appl. No.: 349,459

[22] Filed: Feb. 17, 1982

[51] Int. Cl.[3] ..... E02B 17/04

[52] U.S. Cl. ..... 405/196; 405/203; 405/195; 405/205

[58] Field of Search ..... 405/209, 208, 203, 204, 405/196, 197, 198, 199, 4, 5; 114/265, 264

[56] References Cited

U.S. PATENT DOCUMENTS

| | | | |
|---|---|---|---|
| 2,932,271 | 4/1960 | Crandall | 405/4 X |
| 2,942,425 | 6/1960 | DeLong et al. . | |
| 2,946,566 | 7/1960 | Samuelson . | |
| 3,001,594 | 9/1961 | Suderow | 175/9 |
| 3,007,316 | 11/1961 | Higgins, Jr. . | |
| 3,477,235 | 11/1969 | Branham et al. . | |
| 3,575,005 | 4/1971 | Sumner . | |
| 3,946,684 | 3/1976 | Sumner . | |
| 3,999,396 | 12/1976 | Evans | 114/77 A |
| 4,040,265 | 8/1977 | Hellerman et al. . | |
| 4,103,503 | 8/1978 | Smith . | |
| 4,226,202 | 10/1980 | Conrad | 405/4 X |

FOREIGN PATENT DOCUMENTS

| | | |
|---|---|---|
| 2420026 | 11/1975 | Fed. Rep. of Germany . |
| 2722747 | 8/1977 | Fed. Rep. of Germany . |
| 46227 | 2/1939 | Netherlands . |
| 6802083 | 8/1969 | Netherlands . |
| 2077666 | 12/1981 | United Kingdom . |

OTHER PUBLICATIONS

"Shallow Water Levelling Barge Proposed", *Drilling Contractor,* vol. 37, No. 11, Nov. 1981, pp. 57, 60.

*Primary Examiner*—Dennis L. Taylor

*Attorney, Agent, or Firm*—Fitzpatrick, Cella, Harper & Scinto

[57] ABSTRACT

A shallow water drilling or production barge (46) is adapted for offshore use by means of a novel drydock (40) which has wing walls (52) of substantial freeboard and a platform (74) of essentially no freeboard. Jacking legs (42) extend down through the wingwalls to the sea bed (50). Valves (56) in the wing walls are opened to allow them to partially submerge and lower the platform enough to float the barge into place; and then jacking mechanisms in jacking towers (54) on the wing walls are operated to raise both the drydock and the barge up out of the water. The barge rides or rails 75 supported by roller assemblies on the platform; and after being raised the barge is pulled forwardly and locked in place.

33 Claims, 38 Drawing Figures

108
42
114
122
118
120
52
66
112
110
74
8
9

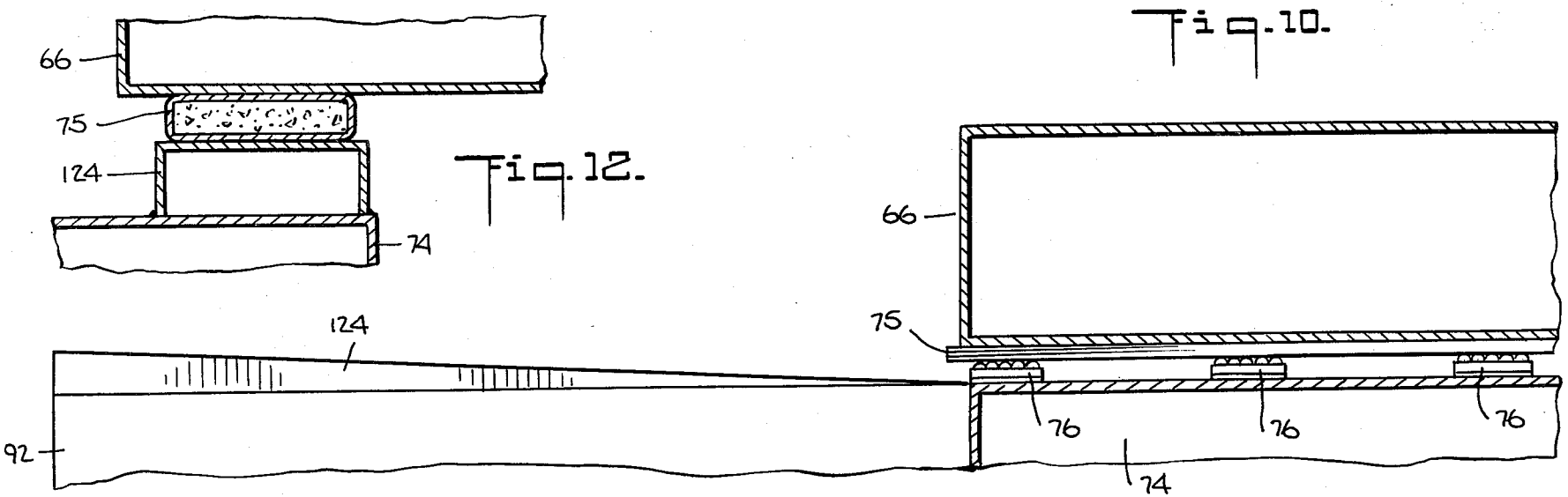
Fig. 10.
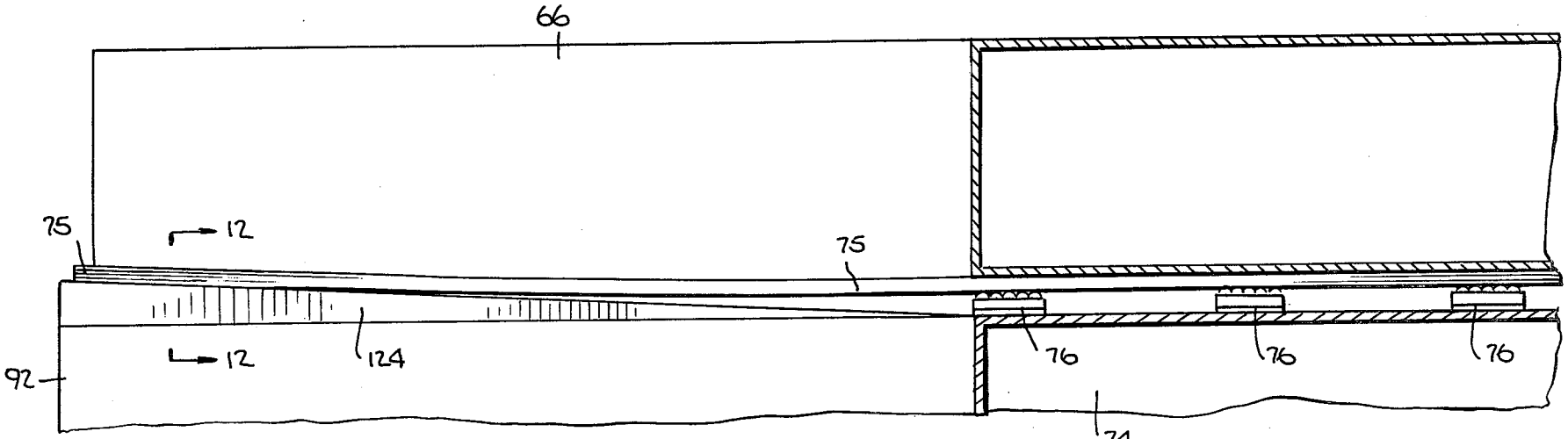
Fig. 11.
Fig. 12.

METHOD AND APPARATUS FOR POSITIONING A WORKING BARGE ABOVE A SEA SURFACE

BACKGROUND OF THE INVENTION

1. Field of the Invention

This invention relates to offshore drilling and producton work and more particularly it concerns novel methods and apparatus for positioning a working barge, such as a drilling or production rig, above a sea surface.

2. Description of the Prior Art

It has previously been proposed to provide a support arrangement which will support a shallow water drilling or production barge above the surface of the water at a deep water location. One such proposed support arrangment is described in U.S. Pat. No. 3,007,316 to A. J. Higgins, Jr. According to the Higgins patent, a platform structure made up of a group of submersible barges is floated to a desired offshore location and then submerged to the sea bottom. A shallow water barge is floated into position between frames extending up from outer ones of the submerged barges. A central submerged barge is then made buoyant and rises, while guided along the frames, until it contacts the bottom of the barge and lifts it up out of the water.

Another proposed support arrangement is described in U.S. Pat. No. 4,040,265 to L. W. Hellerman et al. According to the Hellerman et al patent, a mobil offshore platform of negative buoyancy is carried on a floating vessel to a desired offshore location. The negative buoyancy platform has vertical elongated support legs and jacking mechanisms to lower the legs to the sea bottom and then jack the platform up off the floating vessel. The platform is then jacked down until it is submerged, whereupon a working barge is floated over it. Then the platform is jacked up again on the legs to raise the barge up out of the water.

A still further proposal for positioning a working barge is described in the publication *Drilling Contractor,* Nov. 1981 at pages 57–61. According to that publication, a jackup barge is floated to a drill site and is jacked up out of the water and ballasted with water to force the legs into the ocean bottom. The barge is then deballasted and lowered below the water surface. A working barge or "barge-rig" is then towed into position over the submerged jackup barge and the working barge is then ballasted or flooded so that it rests on top of the jackup barge.

U.S. Pat. No. 2,942,425 to L. B. DeLong et al describes a "mobil dry dock", fitted with jackup legs, to lift marine craft up out of the water. The DeLong et al device is made up of an upper working platform and a lower marine craft receiving and supporting platform with elongated legs passing through each platform and jacking mechanisms on the lower platform. The lower platform comprises a flotatable hull capable of floating and supporting the upper platform and the jacking legs. The lower flotatable hull platform is also provided with a propulsion unit. When the DeLong et al device is floated into position the legs are lowered to the sea bottom and the platforms are jacked up above the water. The upper platform is then pinned to the legs and the lower platform is lowered until it becomes submerged. The patent states that valves are provided in the lower platform to permit water to enter the platform while it is being submerged. A marine craft to be raised is then floated over the submerged lower platform. The lower platform is then jacked up on the legs to raise the marine craft up out of the water.

The techniques proposed by Higgins, Hellerman et al and DeLong et al all require complex and expensive equipment. The techniques proposed by DeLong and in the Drilling Contractors publication suffer from the further disadvantage that the very platform on which the jacking mecahnisms are mounted must be submerged to permit the marine vessel or working barge to float over it. This poses substantial problems in mounting and arranging the jacks so that they can be operated efficiently and reliably. Also, in the case of the DeLong et al arrangement, the rate at which the lower platform can be submerged or raised out of the water depends on how rapidly the platform can be filled or drained through its valves.

SUMMARY OF THE INVENTION

The present invention overcomes the above described disadvantages of the prior art and provides novel and economical methods and apparatus for positioning a shallow water drilling or production barge above a sea surface at a deep water location.

According to the one aspect of present invention there is provided a pair of elongated buoyant wing walls having substantial freeboard and arranged spaced apart and parallel to each other with a horizontal platform of essentially no freeboard extending between and connected to the wing walls. A plurality of elongated jacking legs are mounted to move up and down relative to the wing walls. In the preferred embodiment the jacking legs pass through wells in the wing walls. Jacking mechanisms are mounted on the wing walls and are arranged to engage the legs to move them up and down. Again, in the preferred embodiment, the jacking mechanisms are arranged in jacking towers on top of the wing walls. The wing walls are arranged to have controllable buoyancy such as by valves near the bottom thereof to admit and drain sea water. The jacking mechanisms are arranged on the wing walls to be located above the sea surface when the platform is submerged.

According to another aspect of the invention there are provided roller assemblies mounted in rows along the platform and rails which are mounted to move fore and aft along the roller assemblies. The barge is first floated to a lifting position over the drydock platform with the rails retracted; and then, after the barge and drystock are raised the barge is pulled forwardly while the rails move over the roller assemblies until the barge reaches a working position whereupon it is locked against fore and aft movement on the platform.

There has thus been outlined rather broadly the more general features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangments for carrying out the purposes of this invention. It is important, therefore, that this disclosure be regarded as including such equivalent arrangements as do not depart from the spirit and scope of the invention.

BRIEF DESCRIPTION OF THE DRAWINGS

The invention as above explained is described hereinafter in connection with the preferred embodiments shown in the accompanying drawings forming a part of the specification in which:

FIG. 10 is a view taken along line 10—10 of FIG. 3 showing the initial positioning of a barge on the jackup drydock;

FIG. 11 is a view similar to FIG. 10 but showing the working position of the barge on the jackup drydock;

FIG. 12 is a view taken along line 12—12 of FIG. 11;

The shallow water drilling barge shown herein has been built but is not new and is not claimed herein. The jackup drydock per se and in combination with the shallow water drilling barge are believed to be novel. The jackup drydock shown and described herein has not yet been built.

DETAILED DESCRIPTION OF THE PREFERRED EMBODIMENT

Figure 1:
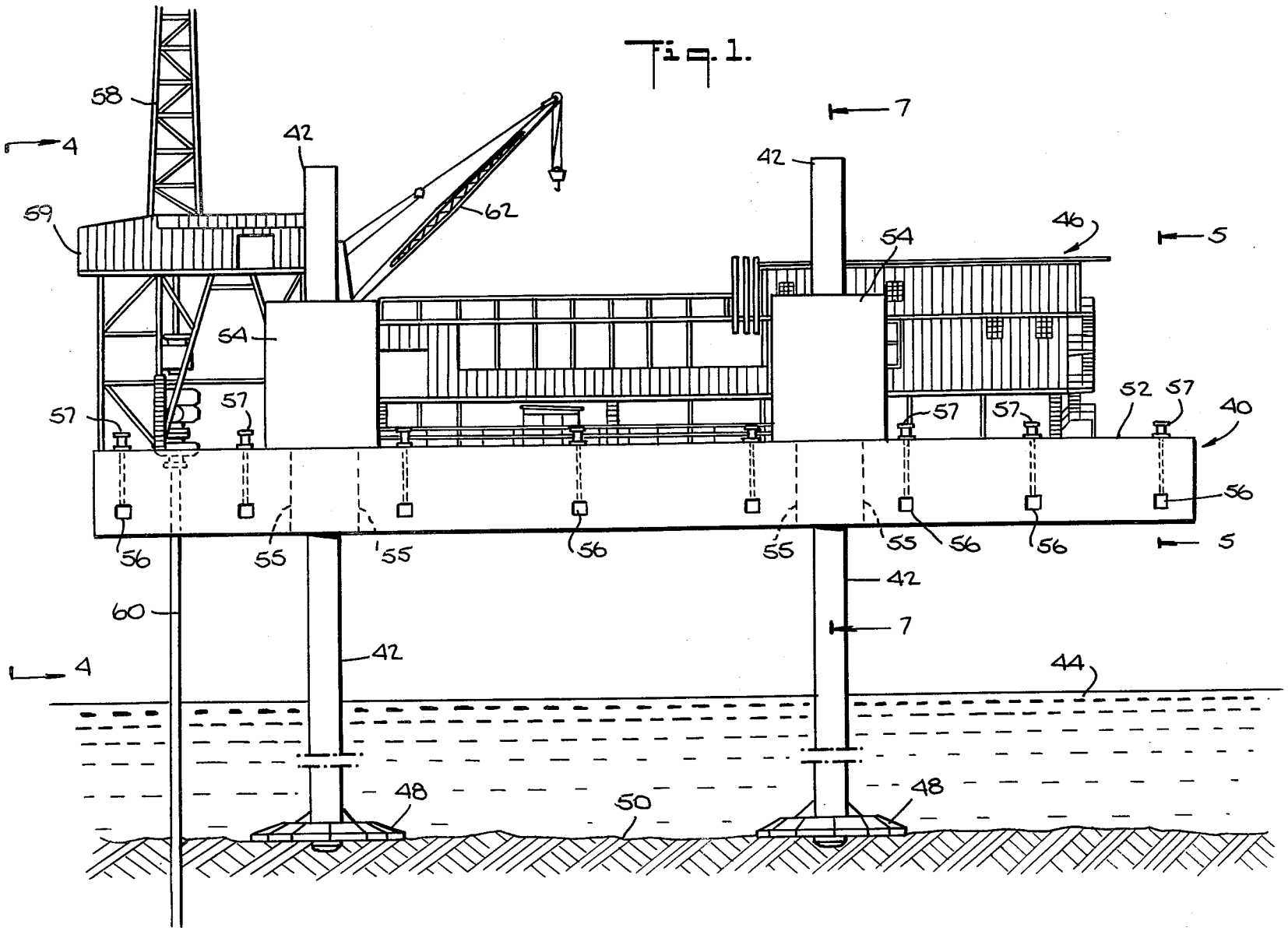
FIG. 1 is a side elevation view of an offshore drilling rig according to the present invention.

The offshore drilling rig shown in FIG. 1 comprises a jackup drydock 40 supported on jacking legs 42 above a sea surface 44 and carrying thereon a shallow water drilling barge 46. The jacking legs 40 are provided at their lower ends with pods 48 which rest on a sea bottom 50. The jacking legs extend up from the pods 48 the sea surface 44 to the jackup drydock 40 where they pass through wing walls 52 on the jackup drydock. The jacking legs continue on through jacking towers 54 mounted on top of the wing walls. Jacking mechanisms (shown and described hereinafter) are provided in the jacking towers 54 to raise and lower the jacking legs 42 relative to the wing walls 52; and, when the leg pods 48 are on the sea bottom 50, to raise and lower the jackup drydock 40 relative to the sea surface 44. The wing walls 52 are of hollow construction and they have variable buoyancy. This buoyancy is controlled by allowing water to flow in and out of compartments formed by bulkheads 55 inside the wing walls. Sea chest valves 56 are provided at various locations along the lower edge of the wing walls to admit water into the compartments and to drain water out from them. Sea chest valve operators 57 extend from the sea chest valves up to the deck to control the operation of the valves 56. By so controlling the wing wall buoyancy, the jackup drydock can be partially submerged to permit placement of the shallow water drilling barge 46.

As shown in FIG. 1, the shallow water drilling barge 46 includes a drilling mast 58 extending up from an elevated drilling platform 59 at one end of the barge. A casing 60 extends down from the mast and through the drilling platform and the jackup drydock to the sea bottom 50. The casing accomodates a drill string during drilling operations and a conductor string during production operations. Lengths of casing drill pipe and conductor pipe (not shown) are carried on the barge 46 and are fed to the drilling mast in a manner well know to those in the field of oil well drilling and production. A derrick 62 is also arranged on the drilling barge 46 to place the drill pipe and to move other heavy equipment as needed for operation of the barge.

Figure 2:
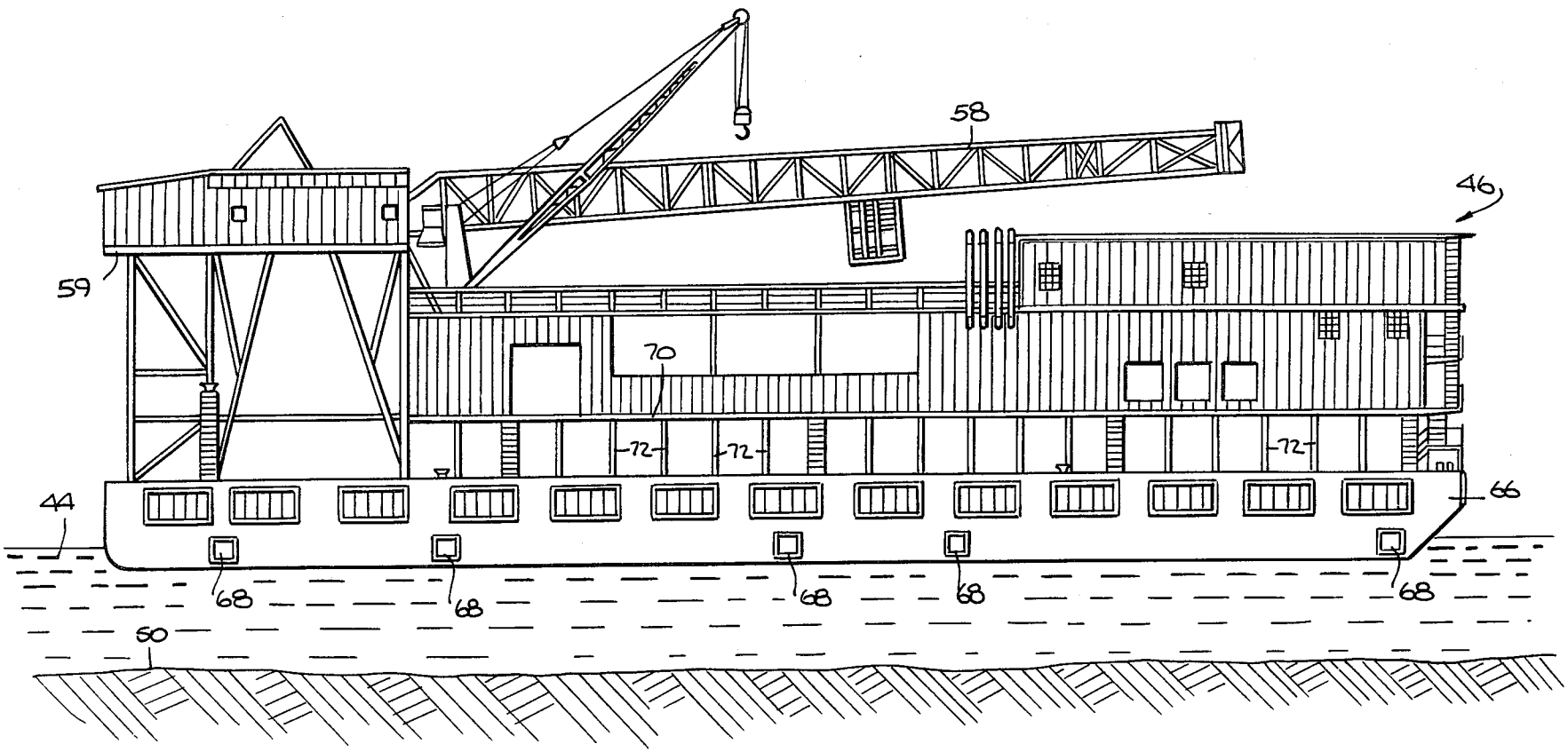
FIG. 2 is a side elevation view of a shallow water drilling barge forming a portion of the offshore drilling rig of FIG. 1.

As shown in FIG. 2 the drilling barge 46 itself has a flotatable hull 66 which is provided with sea chest valves 68 to admit and to drain sea water. The hull 66 has a shallow draft which permits the barge to be floated to desired drilling locations in shallow water and then to be settled down on the bottom for carrying out drilling operations. Such use of shallow water drilling barges is well known and the drilling barge per se does not constitute the present invention.

The drilling barge 146 has a main deck 70 which is supported above the hull 66 by "posts" 72. This ensures that when the hull 66 is submerged and resting on the bottom at a shallow water location the deck 70 will be above the water surface. As can be seen in FIG. 2 the mast 58, the derrick 62 and the drilling platform 59 are all mounted above the main deck 70. Also, for ease in transporting the barge 46, the mast 58 may be pivoted back to extend along and above the main deck 70 as shown in FIG. 2.

Figure 3:
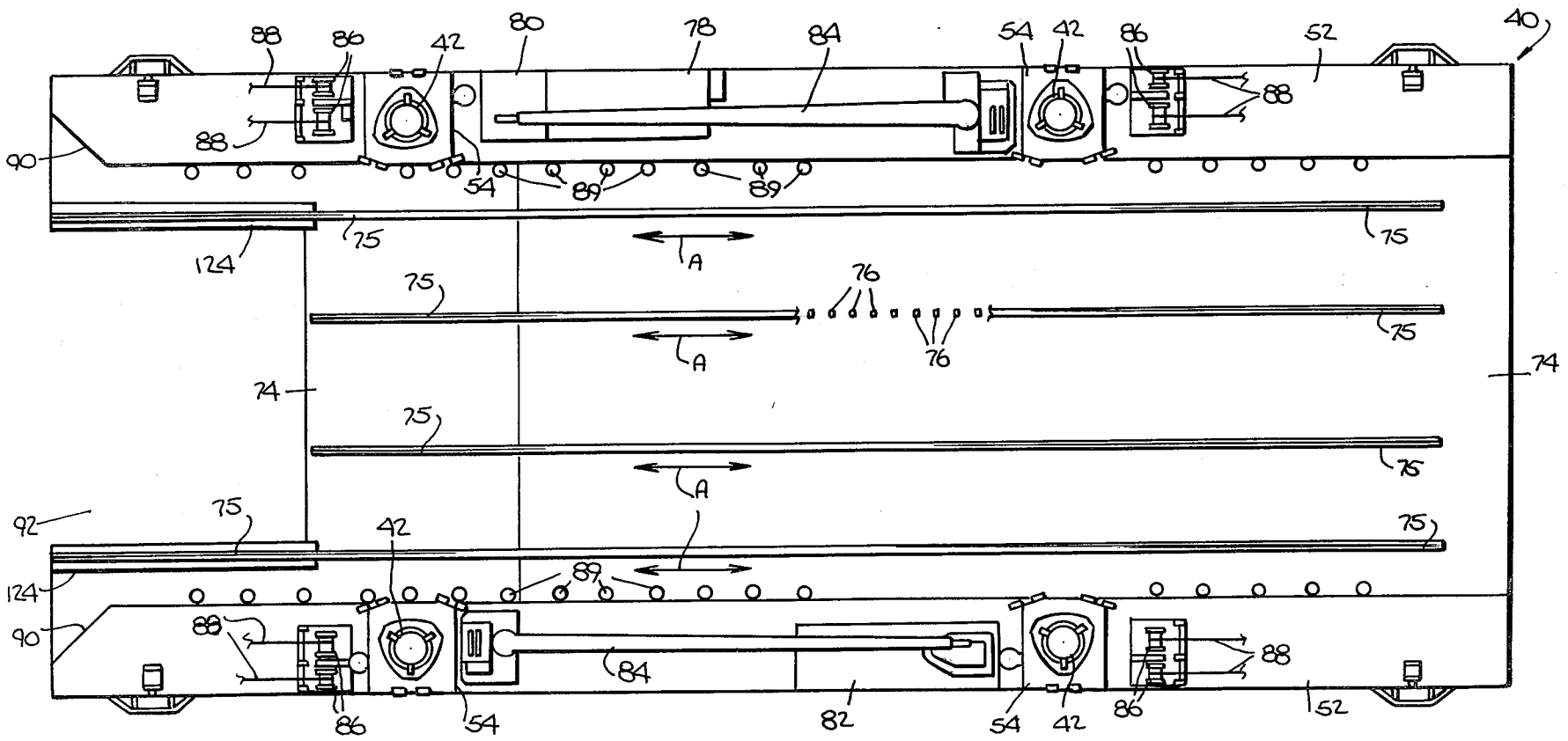
FIG. 3 is a top plan view of a jackup drydock according to the present invention and forming another portion of the offshore drilling rig of FIG. 1.

As can be seen in FIG. 3, the wing walls 52 of the jackup drydock 40 are elongated and are arranged parallel to each other in spaced apart relation along opposite sides of a horizontal barge support platform 74. The width and length of the platform 74 is sufficient to allow the shallow water drilling barge 46 to rest on the platform between the wing walls 52.

Elongated support rails 75 extend along the upper surface of the platform 74 in spaced apart relation and parallel to the wing walls 52. These rails each rest on a plurality of roller assemblies 76 which allow the rails to move freely lengthwise of the jackup drydock even when carrying the drilling barge 46 or a production rig.

There are also provided along the upper surface of one of the wing walls 52 an engine room 78 with an operating room 80 mounted thereon. A crew quarters 82 is provided along the upper surface of the other wing wall. Also, cranes 84 are mounted on each of the wing walls 52 for lifting equipment onto the jackup drydock.

Winches 86 are arranged along the upper surface of the wing wall 52 near each end thereof. These winches pull on cables 88 attached to the drilling barge 46 or production rig to position it over the platform 74.

A plurality of fenders 89 are arranged along the inner surfaces of the wing walls to assist in guiding the drilling barge 46 or production rig into place between the wing walls. Also, the wing walls are flared out, as shown at 90, at one end of the jackup drydock to facilitate the entry of the drilling barge or production rig into place.

At the end of the platform 74 over which the drilling mast 59 of the shallow water drilling barge 46 is to be positioned there is formed a working slot or opening 92 which accommodates the casing 60 when the jackup drydock is drilling position.

Figure 4:
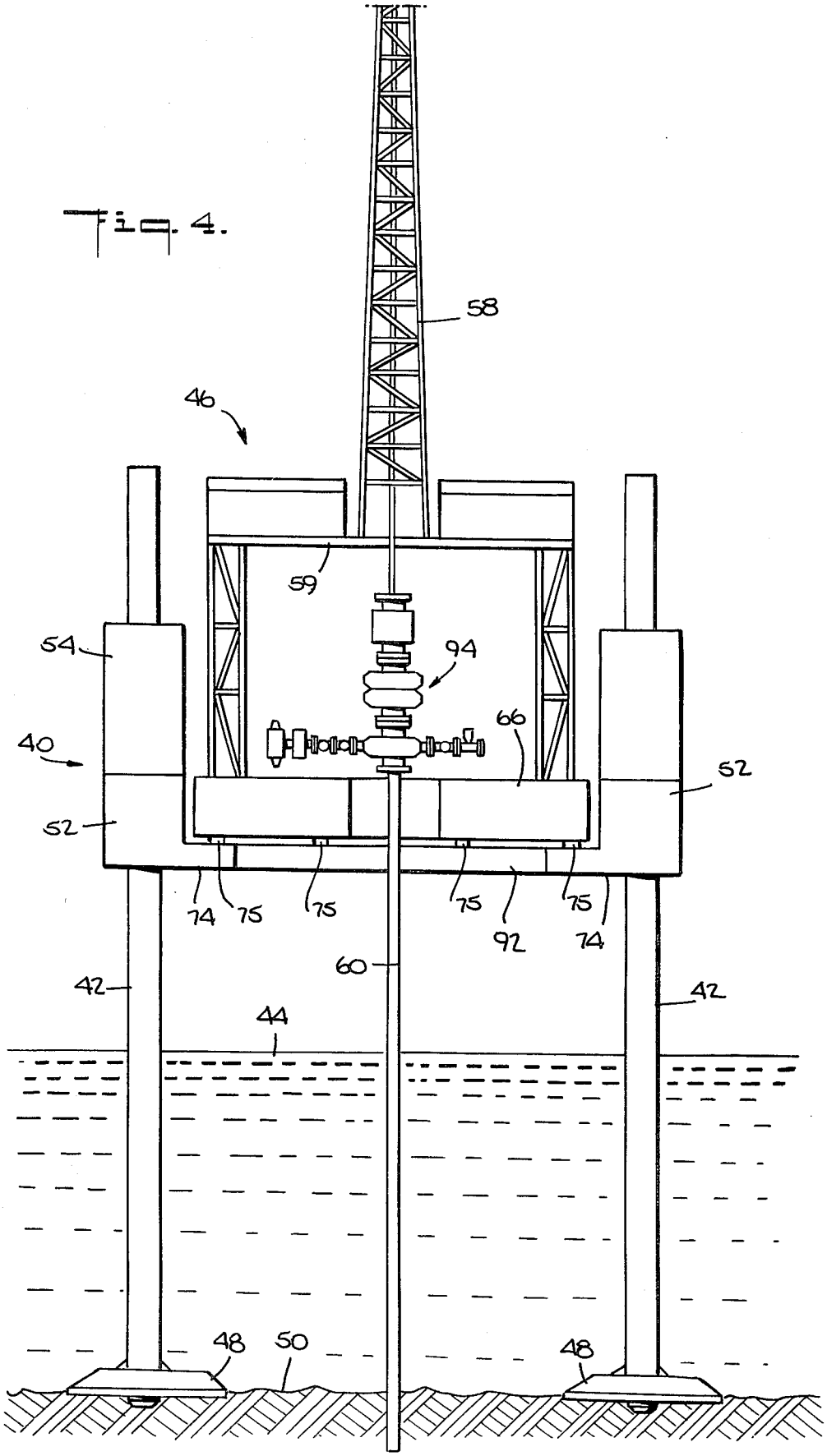
FIG. 4 is an end view taken along line 4—4 of FIG. 1.

Turning now to FIG. 4 it will be seen that a blowout preventer 94, well known in the art, is mounted on top of the casing 60 to seal off the casing in the event an upward surge of oil and gas should occur. The blowout preventer 94, which has a substantial lateral extent, is located between the hull 66 and the drilling platform 59 of the shallow water drilling barge 46. In order to permit placement of the barge 46 so that the blowout preventer 94 is located between the hull 66 and the drilling platform 59, the barge is initially placed in a rearward location, or lifting position, on the jackup drydock 40 until the jackup drydock is raised up above the sea surface. Thereafter the shallow water drilling barge 46 is moved forwardly, as will be explained hereinafter, to bring it into its working position as shown in FIGS. 1 and 4.

Figure 5:
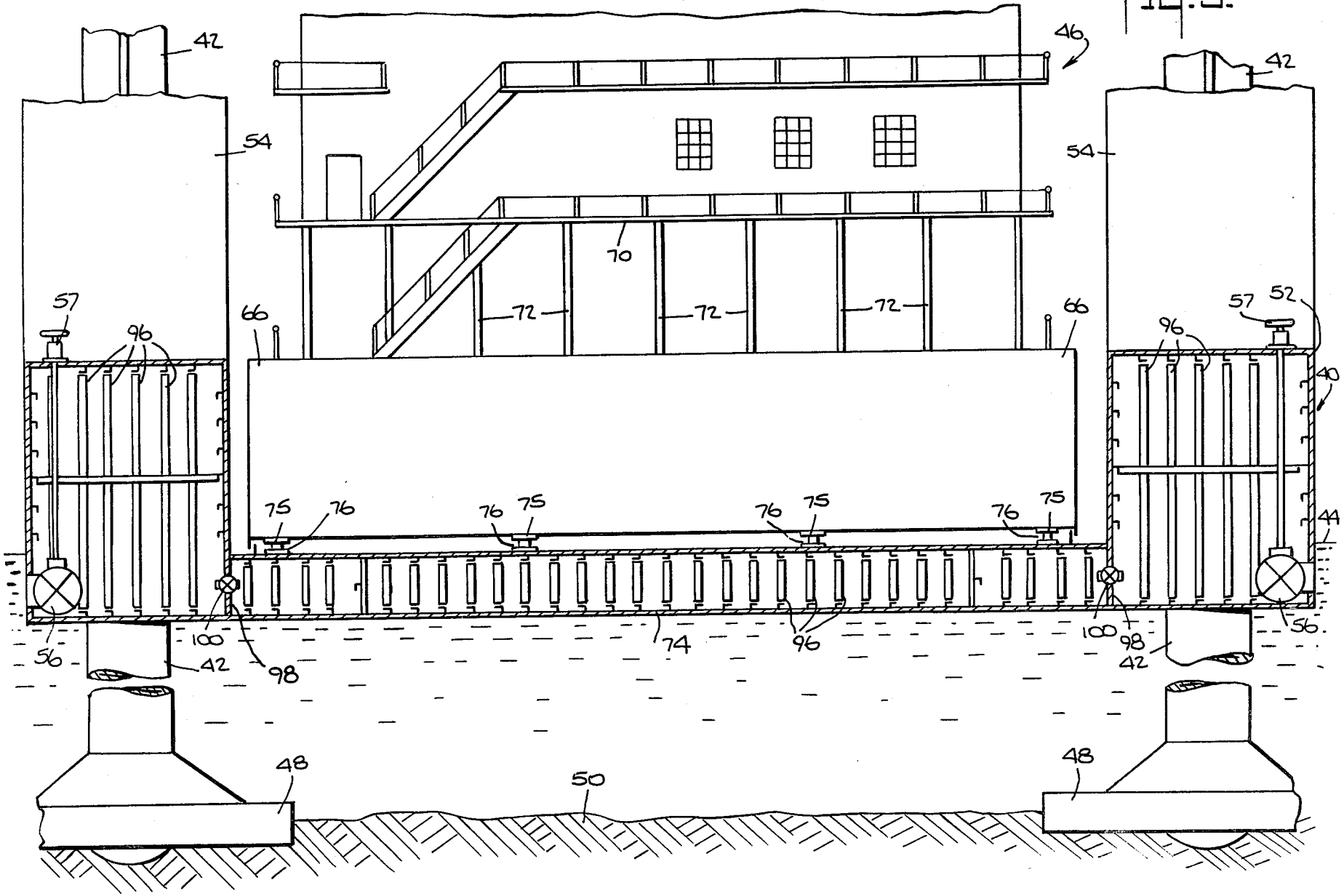
FIG. 5 is a view, partially in section, taken along line 5—5 of FIG. 1.

As shown in FIG. 5, the barge support platform 74 of the jackup drydock 40 interconnects the wing walls 52 along their lower edges. Both the wing walls 52 and the barge support platform 74 are of hollow constructon and they are provided with internal stiffeners 96 to maintain their strength and rigidity. By virtue of this construction the barge support platform 74 may also be of variable buoyancy. Internal bulkheads 98 and valves 100 are also provided inside the wing walls and the platform to control the flow of water between them. This permits selective ballasting of different portions of the jackup drydock which is useful in setting its legs 42 firmly on the sea bed 50 before the shallow water drilling barge 46 is raised up to operating position.

It will be noted from FIG. 5 that the wing walls 52 have substantial freeboard, i.e. vertical height above the sea surface 44, in the normal floating position of the jackup drydock. The barge support platform 74, however, has little or no freeboard. Thus it is not necessary to submerge the wing walls completely in order to lower the barge support platform 74 enough to allow the shallow water drilling barge 46 to be floated into position over the submerged platform.

FIGS. 6–9 show the construction and arrangement of the jacking legs 42 and the manner in which they are mounted in the wing walls 52.

Figure 6:
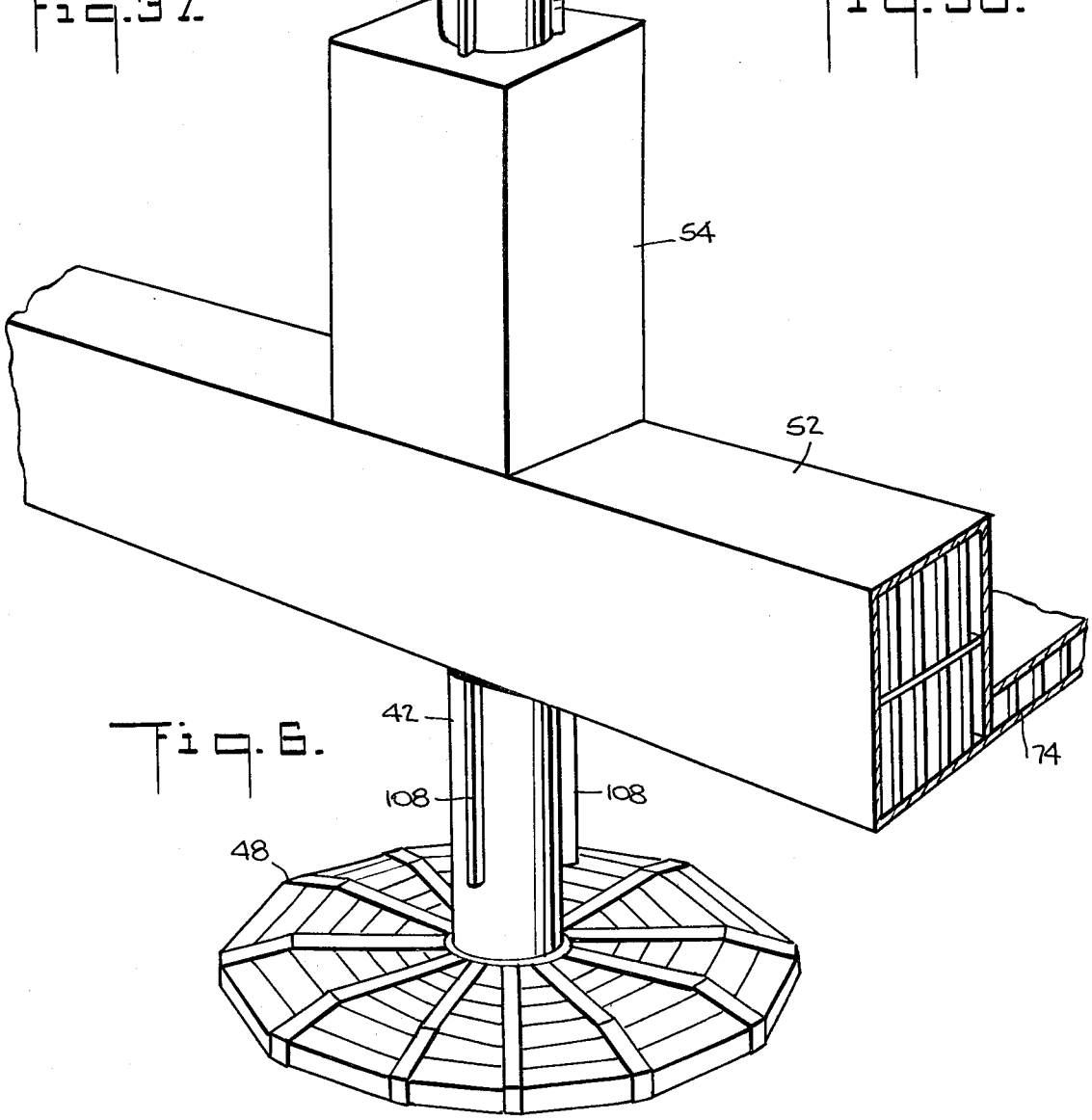
FIG. 6 is a fragmentary perspective view showing a jacking leg mounting arrangement forming part of the jackup drydock of FIG. 3.
Figure 8:
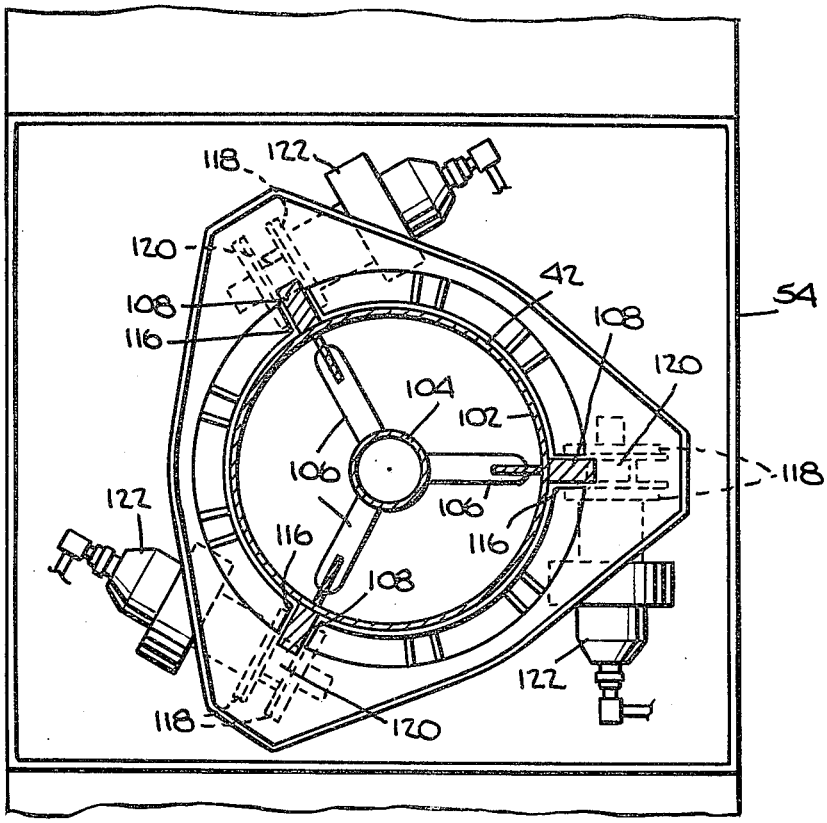
FIG. 8 is a section view taken along line 8—8 of FIG. 7.
Figure 9:
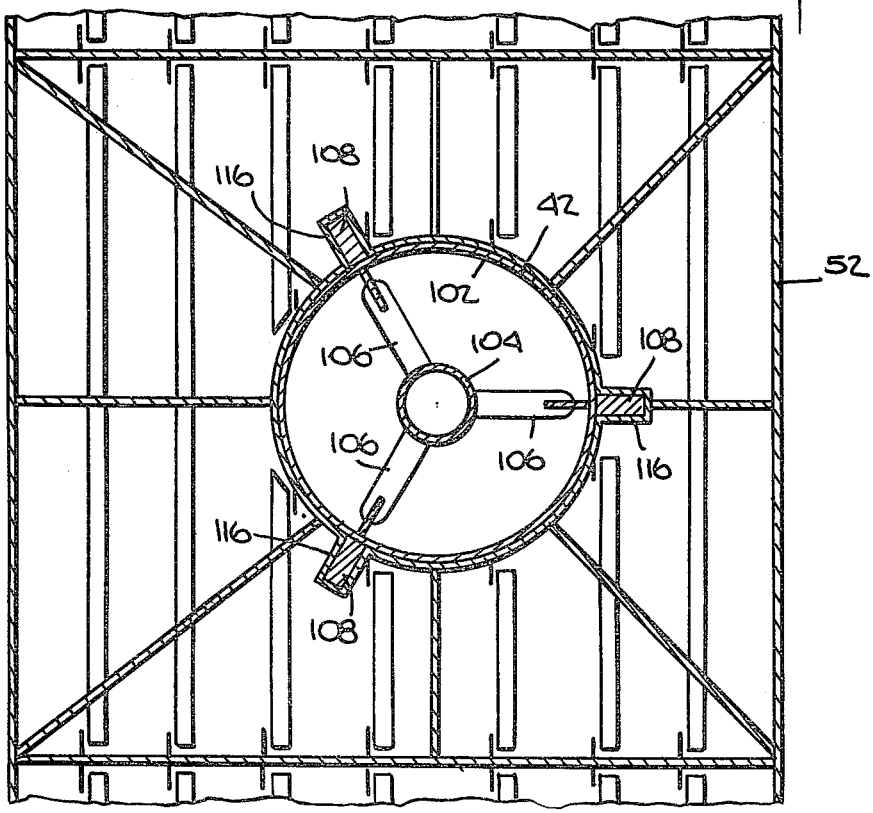
FIG. 9 is a section view taken along line 9—9 of FIG. 7.

As can be seen in FIGS. 6, 8 and 9, the jacking legs 42 are of cylindrical configuration and they comprise an outer cylindrical wall 102, an inner axial wall 104 and three equispaced radial ribs 106. Along the outside of the cylindrical wall 102, in line with the radial ribs 106, there are provided gear racks 108.

Figure 7:
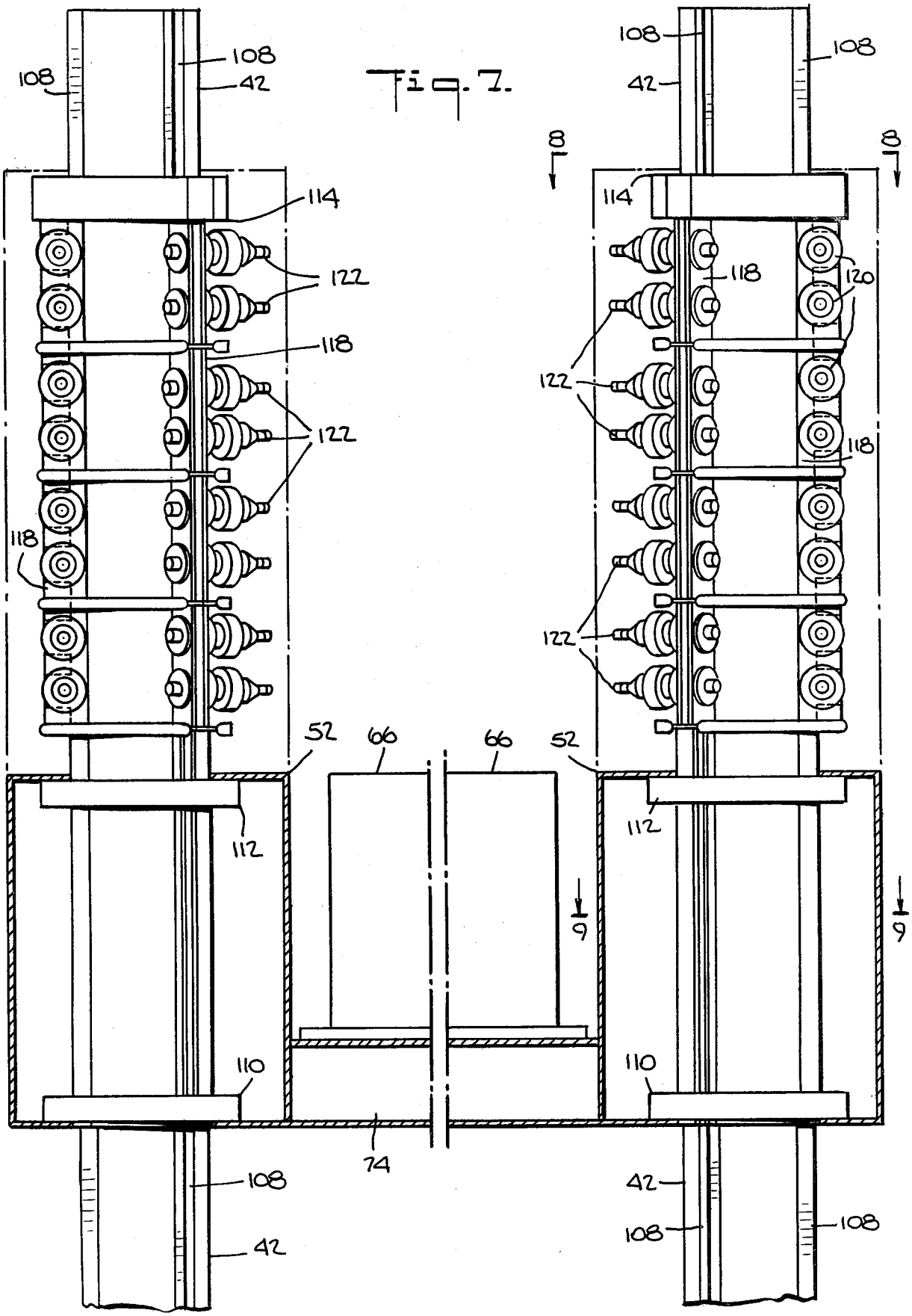
FIG. 7 is an enlarged section view taken along line 7—7 of FIG. 1.

Turning now to FIG. 7 it will be seen that there are provided jackup leg guides 110, 112 and 114 mounted respectively on the floor and the upper surface of the wing walls 52 and at the top of the jack housing 54. As shown in FIGS. 8 and 9, the guides closely accomodate the outer surface of the legs 42 and they are provided with recess formations 116 to accomodate the gear racks 108.

Inside the jack housings 54 there are provided pairs of elongated gear support plates 118 which extend between the guides 112 and 114. Each pair of support plates straddles one of the leg gear racks 108. The support plates 118 also serve to mount pinion gears 120 (FIG. 8) which are meshed with the gear racks 108. Hydraulic drive motors 122 are also mounted on the support plates 118 and are connected to drive the pinion gears. The general construction of the gear rack, pinion and hydraulic drive motors arrangement is well known and is available from Superior Lift-Boat and Rig Mfg. Inc., Route 3, Box 555, AB Lafayette, La. 70505. Accordingly the details of the construction of these items will not be described herein, suffice it to say that the motors 122 are driven in unison to turn the pinions in one direction or another to move the jacking legs 42 up or down relative to the jackup drydock 40 or, conversely, to move the jackup drydock down or up relative to the legs. The motors 122 can be independently controlled from leg to leg so that substantially all of the weight of the jackup drydock will be imposed on two or three of the legs to set them firmly into the sea bed 50. Other jacking arrangements, using leg gripping devices and hydraulic or pneumatic piston and cylinder arrangements, well known in the art, may also be used.

FIGS. 10–14 show the construction of the support rails 75 and roller assemblies 76 which are used to position the shallow water drilling barge 46 on the jackup drydock 40. Referring first to FIG. 1 it will be seen that the support rails 75 are moveable fore and aft along the roller assemblies 76 in the direction of the arrows A. Also, FIG. 3 shows the rails 75 in their most forward position which corresponds to the shallow water drilling barge 46 being located in its working position. The forward ends of the outermost rails extend alongside the working slot 92 and the forward ends of the inner rails terminate at the inner edge of the slot. The rearward ends of the rails 75 are well inboard of the rearward end of the jackup drydock. When the shallow water drilling barge 46 is moved back to the position it assumes for raising and lowering, the rails 75 roll back by a distance corresponding to the length of the slot 92, i.e. until the forward end of the outer rails is about even with the inner edge of the slot.

As can be seen in FIGS. 1 and 10, there is provided a ramp 124 on the upper surface of the platform 74 along each side of the slot 92 in alignment with the outer rails 75. The ramp 124 tapers upwardly at an angle of about 6°. As can be seen in FIG. 10, the roller assemblies 76 do not extend into the region of the ramp 124. Accordingly, as the rails 75 carrying the barge hull 66 roll forwardly past the forwardmost roller assembly, the rails 75 move forwardly in cantilever fashion toward the upwardly inclined ramp 124 until, as shown in FIG. 11, they encounter the ramp about half way along the length of the slot 92. As the outer rails 75 continue to move forewardly they are wedged upwardly by the ramps 124. This causes the forward portion of the barge 46 to become solidly engaged with the forward end of the jackup drydock when the barge is in its forward or working position, as shown in FIG. 12, so that the weight of the mast portion of the barge is applied directly to the platform and not via the roller assemblies. This solid engagement is important because it ensures against slipping or settling of the barge during drilling operations. In order to facilitate the movement of the rails 75 on the ramps 124, grease or other suitable lubricant can be applied to the ramp surfaces.

Figures 13, 14, 15:
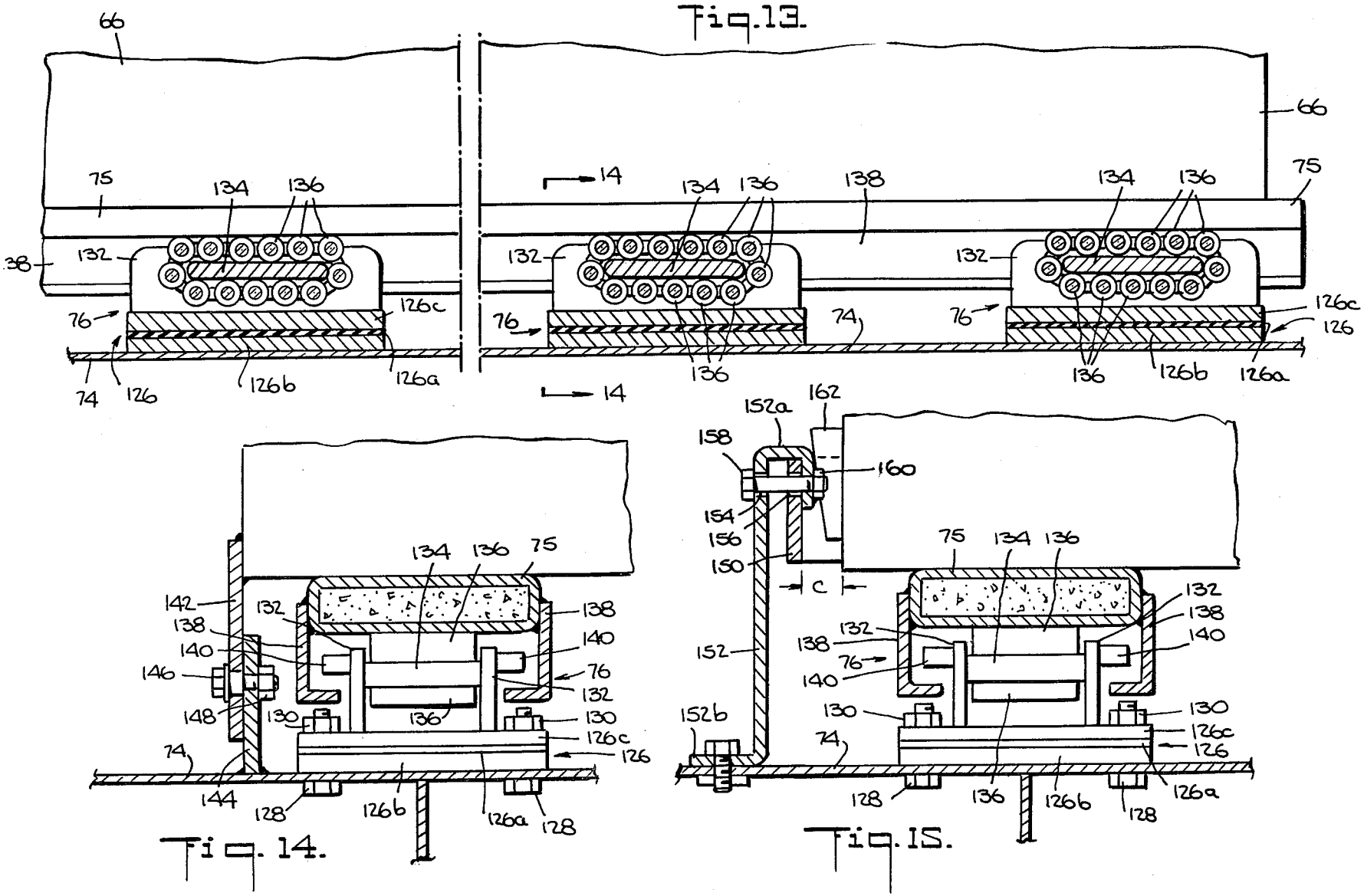
FIG. 13 is an enlarged fragmentary view showing a roller and rail arrangement used in the jackup drydock.
FIG. 14 is a view taken along line 14—14 of FIG. 13.
FIG. 15 is a view similar to FIG. 14 but showing an alternate construction.

The construction of the roller assemblies 76 is best seen in FIGS. 13 and 14. As there shown, each roller assembly comprises a base 126 formed of a layer **126*a* of soft resilient material, such as neoprene, interposed between two metal plates 126*b* and 126*c*. The base 126 is bolted to the upper surface of the platform 74 by means of bolts 128 and nuts 130. A pair of vertical plates 132 extend up from the base 126 and these plates support between them an upper horizontal plate 134. A plurality of rollers 136 are linked together around the upper horizontal plate 134 and the rail 75 rests on the upper rollers. As the rail moves along, the rollers 136 roll around the upper horizontal plate 134. The rails 75 themselves are of hollow steel construction and are filled with pressure resistant concrete for stiffness. Each rail 75 is provided with side plates 138 which extend downwardly and which bend inwardly under lateral lugs 140 on the roller assemblies 76. This arrangement ensures that the rails 75 will not come off from the roller assemblies 76**.

The roller assemblies 76 per se are known in the prior art; and an example of such rollers is known as "OT Rollers" supplied by Hilman Incorporated, 2604 Atlantic Ave., Wall, N.J. 07719. However it is believed that the arrangement of those roller assemblies as described herein, i.e. with the roller assemblies mounted in fixed position, upside down on a submersible platform to support and guide barge hull support rails, is novel.

As can also be seen in FIGS. 13 and 14, there is provided a fore and aft locking arrangement for securing the barge hull 66 from fore and aft movement on the rails 75 once it has been brought to its operating or working position. The fore and aft locking arrangement comprises an elongated flange 142 which extends downwardly from along the outer edge of the barge hull. A corresponding upwardly extending flange 144 is welded to the platform 74 alongside the barge hull flange 142. The flanges are arranged such that when the barge hull moves along on the rails 75 the two flanges 142 and 144 move past one another in close parallel relationship. Each of the flanges 142 and 144 is provided with a series of holes; and when the barge hull is brought to its operating or working position, one or more bolts 146 are passed through aligned holes on the two flanges and are secured in place with nuts 148. In this manner the barge hull will be secured from inadvertant movement such as might otherwise result if one of the platform legs should settle in the sea bed 50.

FIG. 15 shows an alternate fore and aft locking arrangement which is proposed as a means to compensate for variations in lateral barge dimensions or variations in lateral positioning of the barge hull 66 on the rails 75. As shown in FIG. 15, the railing 150 is attached to the barge hull 66 along its lower edge, the rail being formed so as to allow a substantial clearance (c) between itself and the barge hull. There are also provided a plurality of hangar elements 152 formed with hook-like upper ends **152*a* which extend over the railings 150. The lower ends of the hanger elements 152 are bent outwardly at 152*b* and are there bolted to the upper surface of the platform 74. The hook-like upper ends 152*a* and the railings 150 are each formed with a series of oversize holes 154 and 156; and when the barge hull is positioned at its working location, bolts 158 are passed through these holes and are secured in place by nuts 160. Before the nuts 160 are tightened, aluminum wedges 162 are driven in between the barge and the hangar elements 152 to force the hangar elements out against the railing 150. The hangar elements 152** will provide a degree of flexibility to compensate for variations in barge hull size and positioning.

The exact dimensions of the jackup drydock are not critical to the present invention. Nevertheless, the basic dimensions of an illustrative arrangement are given below:

| | |
|---|---|
| Overall length | 230 ft. (70.1 m) |
| Overall width | 98 ft. (29.9 m) |
| Height of wing walls | 18 ft. (5.5 m) |
| Width of wing walls | 14 ft. (4.3 m) |
| Width of platform | 70 ft. (21.3 m) |
| Height of platform | 4 ft. (1.2 m) |
| Width of working opening | 50 ft. (15.2 m) |
| Length of working opening | 40 ft. (12.2 m) |
| Distance between centers of jacking legs | 104 ft. (31.7 m) |
| Distance of center of jacking legs closest to working slot end to end | 56 ft. (17.1 m) |
| Diameter of jacking legs | 6 ft. (1.8 m) |
| Length of jacking legs | 125 ft. (38.1 m) |
| Cross sectional dimension of rails | 8" × 2" (20 cm × 5 cm) |
| Height of rails above platform | 0.5 ft. (15 cm) |
| Distance between inner rails | 20 ft. (6.1 m) |
| Distance of outer rails from inner rails | 15 ft. (4.6 m) |
| Number of roller assemblies per rail | 89. |

FIGS. 16–38 illustrate the use of the present invention, as describe above, in the positioning of a shallow water drilling barge above a sea surface and the subsequent removal of such barge.

Figure 16:
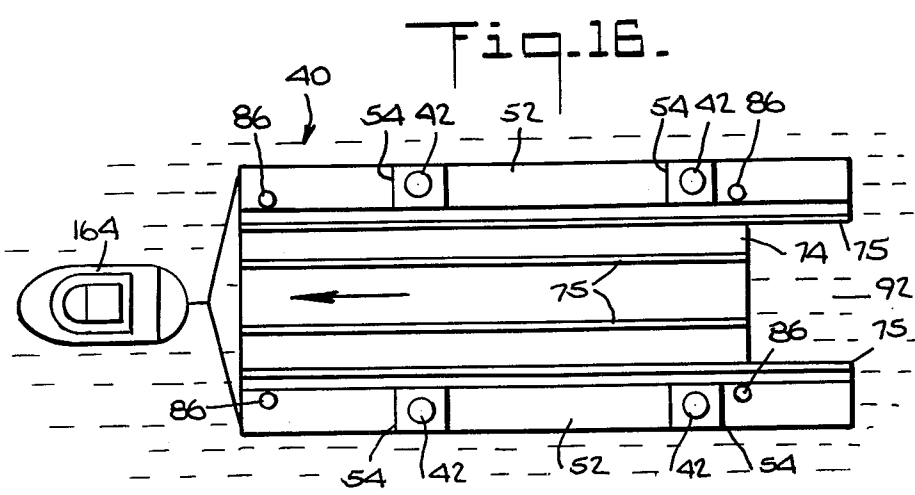
FIG. 16 is a plan view showing the jackup drydock of FIG. 3 being towed to an offshore site.
Figure 17:
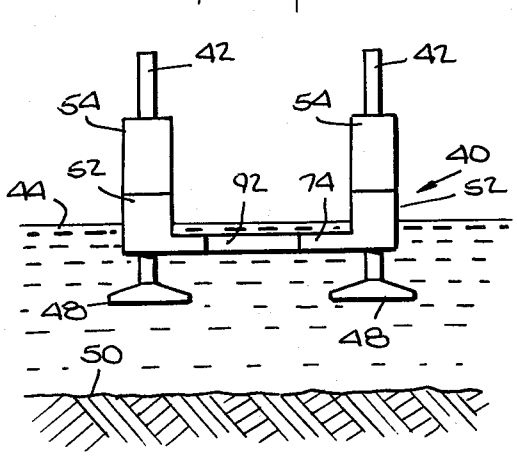
FIG. 17 is an end view of the jackup drydock of FIG. 16.

As shown in FIG. 16, the jackup drydock 40 is towed, in floating condition, by means of a tugboat 164, to an offshore site. During this towing operation the rails 75 on the drydock platform 74 are in their forwardmost position as shown in FIG. 3. Referring now to FIG. 17, it will be seen that during the towing operation the jackup legs 42 are carried in their raised position. The wing walls 52 provide substantial freeboard above the sea surface 44 while the platform 74 has little or no freeboard; and, in fact, the platform 74 can even be slightly submerged. The jacking legs 42 provide a degree of stability and they can be raised or lowered during towing to adjust the center of gravity of the drydock relative to its center of buoyancy. Also, the jackup legs 42 act in the nature of a keel to dampen any rolling action that a rough sea might impose on the jackup drydock during towing.

Figure 18:
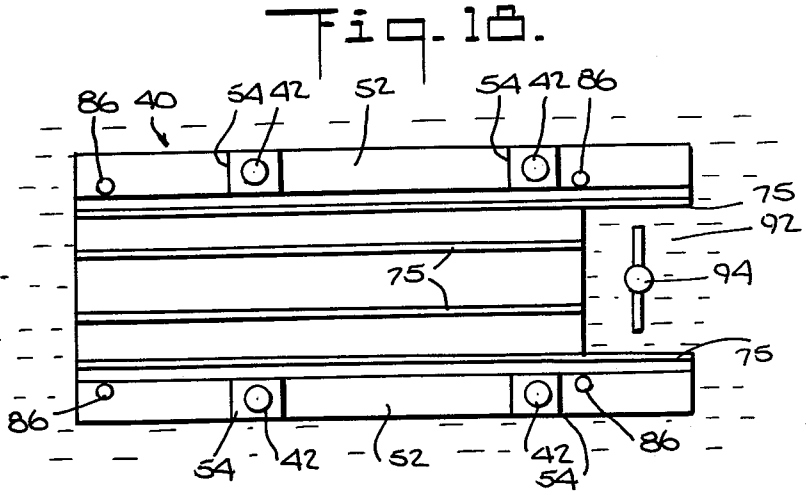
FIG. 18 is a view similar to FIG. 16 and showing the jackup drydock at a drilling site.

The jackup drydock may be towed to any desired location. For example, it can be positioned at a partially or previously drilled well as shown in FIG. 18. In such case the jackup drydock is positioned so that the blowout preventer 94 on the partially or previously drilled well fits inside the working slot 92 of the jackup drydock.

Figure 19:
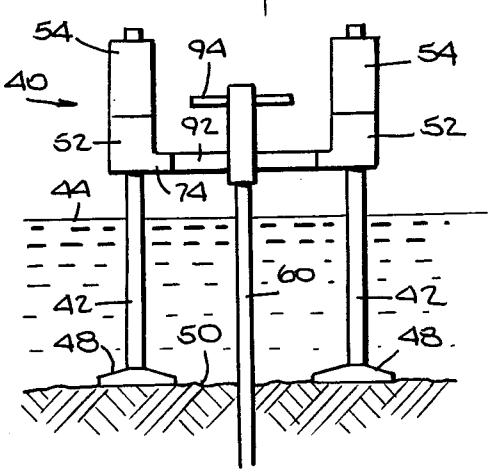
FIG. 19 is an end view of the jackup drydock of FIG. 18 during placement of its jackup legs on the sea bottom.

Once the jackup drydock is in position, the jacking mechanism are operated to lower the legs 42 until the pods 48 reach the sea bed 50. The jacking operation is then continued to lift the jackup drydock up above the sea surface 44, as shown in FIG. 19. When the jackup drydock is thus raised, different ones of the jacking mechanisms are operated to remove weight from different legs. This places extra weight on the remaining legs and serves to ensure that they are fully secured to the sea bed 50. By selective operation of the jacking mechanisms extra weight may be transferred to each leg to secure it to the sea bed. Also, a greater amount of weight may be added to each leg by first opening the sea chest valves 56 (FIG. 1) to allow water to enter the wing walls 52 and the platform 74 before the jackup drydock is raised up on the legs 42. The sea chest valves may then be closed and the jackup drydock raised up with a load of sea water contained in it. In such case the load of sea water serves as extra weight or ballast to firmly implant the bottoms of the legs 42 into the sea bed 50.

Figure 20:
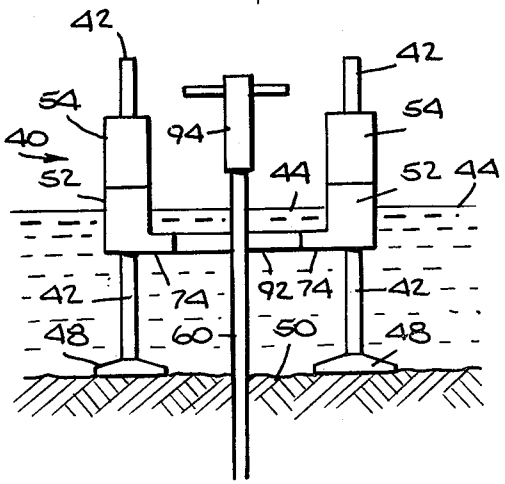
FIG. 20 is a view similar to FIG. 19 but showing the jackup drydock partially submerged to receive a shallow water drilling barge.

After the legs of the jackup drydock have been firmly positioned on the sea bed at the working location, the jackup drydock is lowered, as shown is FIG. 20 so that the horizontal platform 74 is submerged beneath the sea surface 44. During this time the sea chest valves 56 (FIG. 1) are opened and water can flow into the wing walls 52 and the horizontal platform 74 to compensate for buoyant effects and to avoid any uplift forces on the legs 42. It will be noted that because of the substantial freeboard of the wingwalls 52, they are not submerged; and the jacking mechanisms, which are located in the jacking towers 54 on top of the wing walls 52, are maintained well clear of the water.

Figure 21:
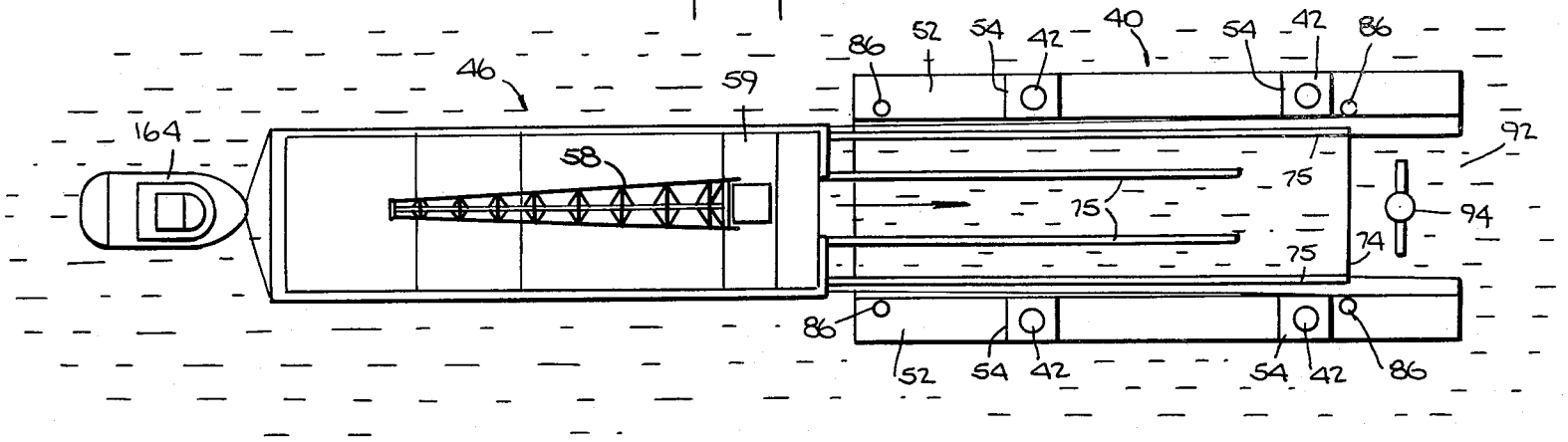
FIG. 21 is a plan view showing the floating of a shallow water drilling barge onto the partially submerged jackup drydock.
Figure 22:
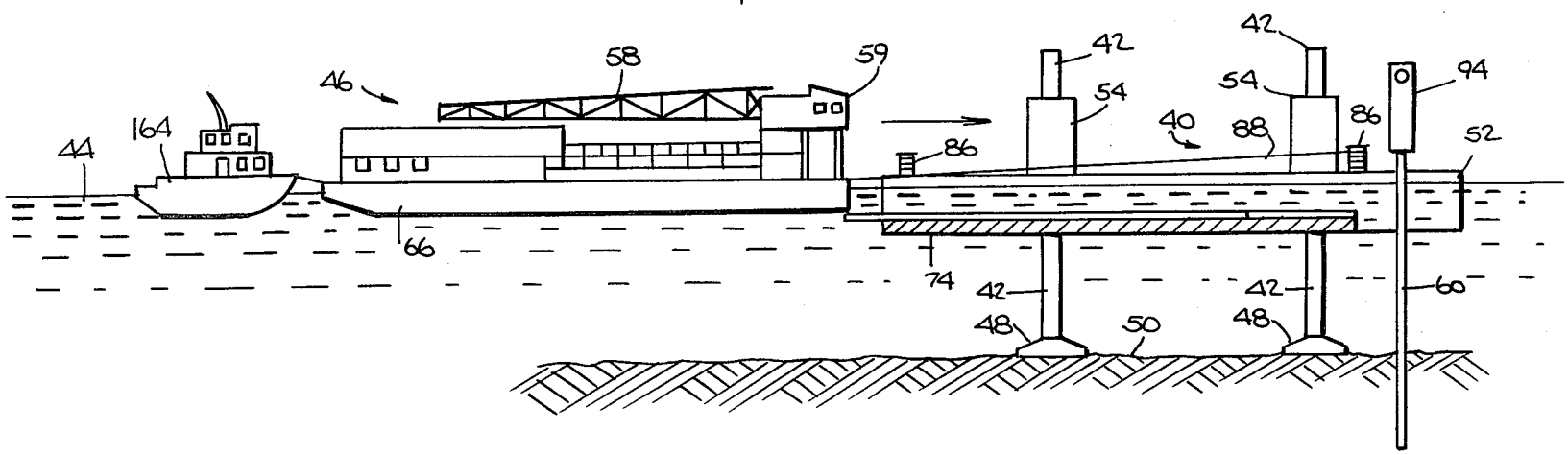
FIG. 22 is a side elevation view, partially in section, of the shallow water drilling barge and the partially submerged jackup drydock of FIG. 21.

At the time that the jackup drydock 40 is partially submerged as described above, the rails 75 are rolled to their rearward position as shown in FIG. 21. Also, as shown in FIG. 21, the shallow water drilling barge 46 is driven by the tugboat 164 into position between the wing walls 52 and over the submerged horizontal platform 74 of the jackup drydock. As shown in FIG. 22, the cables 88 from the winches 86 are attached to the shallow water drilling barge 46 and the winches are operated to pull the barge into jackup position on the jackup drydock.

Figure 24:
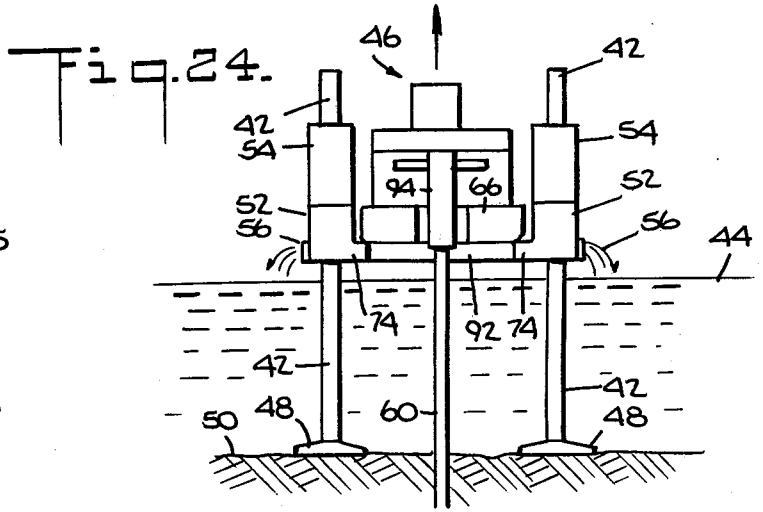
FIG. 24 is a side elevation view, partially in section, of the shallow water drilling barge and the partially submerged jackup drydock of FIG. 23.
Figure 23:
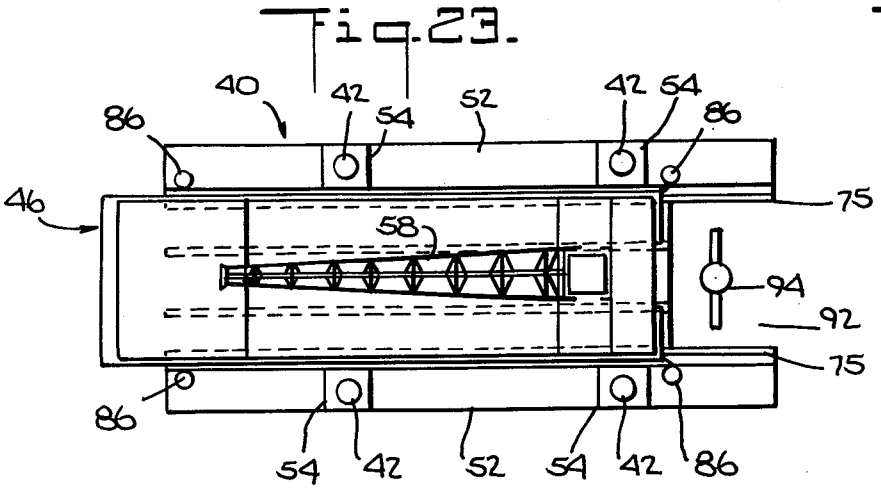
FIG. 23 is a plan view showing the shallow water drilling barge in position to be lifted by the jackup drydock.

FIGS. 23 and 24 show the shallow water drilling barge 46 in jackup position on the jackup drydock. As can be seen in FIG. 24, the draft of the shallow water drilling barge is less than the depth of the submerged horizontal platform 74 and the barge is simply floated to its jackup position. The jackup position of the barge 46 is aft of its working position over the working slot 92 of the jackup drydock. This is because the blowout preventer 94 cannot be accommodated between the hull 66 and the drilling platform 59 of the barge 46 when the barge is in its floating position. Thus the barge is positioned rearwardly of the working slot 92 of the jackup drydock during lifting.

Figure 25:
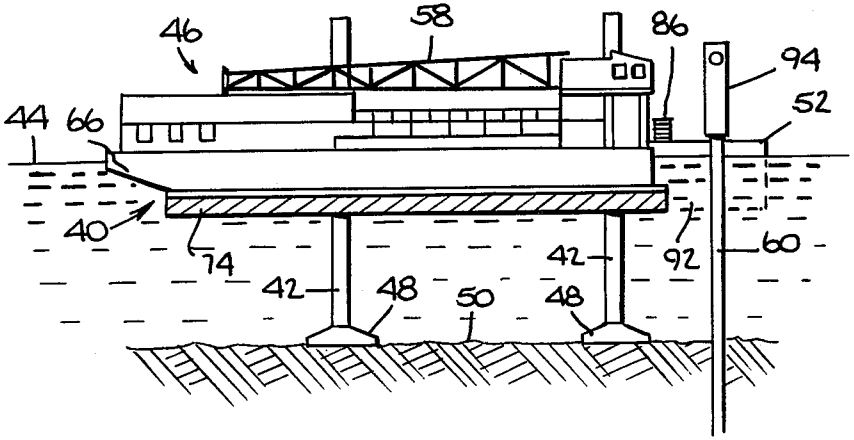
FIG. 25 is an end elevation view showing the jacking up of the jackup drydock to lift the shallow water drilling barge above the sea surface.

Once the shallow water drilling barge 46 is in its jackup position, the jacking mechanisms are operated to raise the jackup drydock 40, and the barge 46 with it, as shown in FIG. 25. While the jackup drydock is being raised up out of the water, its sea chest valves 56 are open so that water contained in the wing walls 52 and the platform 74 can freely flow out, as can be seen in FIG. 25. This minimizes the weight of the barge-drydock assembly and avoids overburdening the legs 42 and the jacking mechanisms. It is important to note that the amount of water which passes out from the wing walls 52 and the platform 74 via the sea chest valves 56 is considerably less than the amount of water which was above the platform when the barge was floated into place. However, because of the jackup drydock configuration, with the wing walls rising up on opposite sides of the platform 74, the water over the platform simply flows off the ends of the platform and does not subject the jackup drydock to any weight during jacking. This is a substantial improvement over the prior art because only a small portion of the water contained in the barge-drydock assembly actually has to be lifted.

Figure 26:
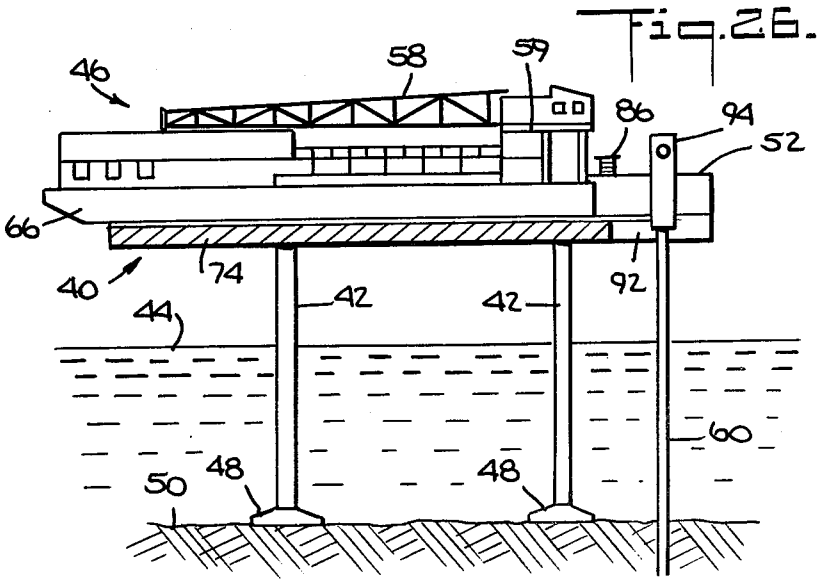
FIG. 26 is a side elevation view, partially in section, showing the fully elevated jackup drydock and shallow water drilling barge.

FIG. 26 shows the fully raised barge 46 and jackup drydock 40. As can be seen, the blowout preventer 94 is now located between the hull 66 and the drilling platform 59 of the shallow water drilling barge 46 so that the drilling barge may be moved forwardly to its working position without interferring with the blowout preventer.

Figure 27:
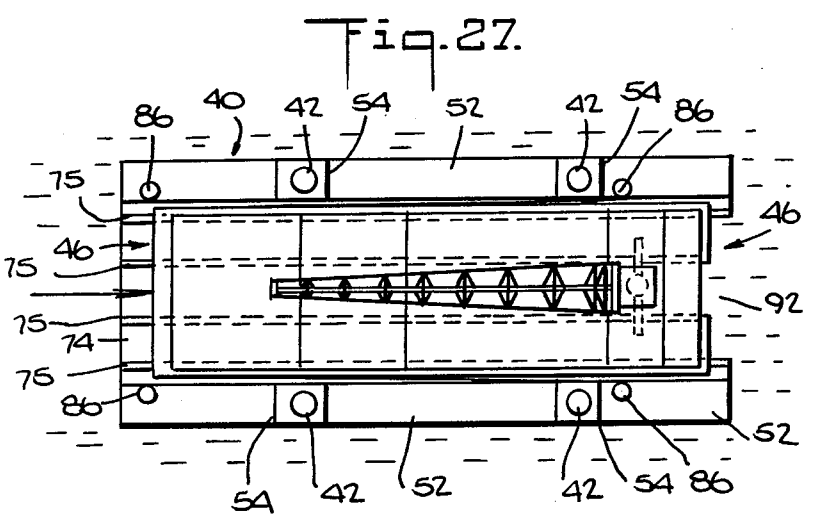
FIG. 27 is a plan view showing the positioning of the shallow water drilling barge on the elevated jackup drydock.
Figure 28:
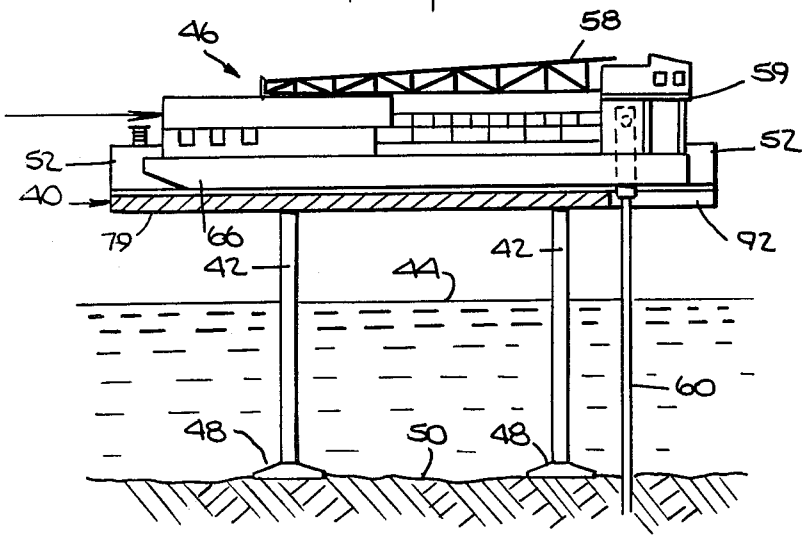
FIG. 28 is a side elevation view, partially in section, of the jackup drydock and shallow water drilling barge of FIG. 20.

FIGS. 27 and 28 show the drilling barge 46 being pulled forwardly from the lifting position to the working position on the jackup drydock 40. As the barge moves forwardly it rests on the rails 75 which roll along the roller assemblies 76. The winches 86 and cables 88 (FIG. 3) may be operated to pull the barge and rails forwardly. Once the barge has been placed in the working position it is locked in place as described above in connection with FIGS. 13–15.

Figure 29:
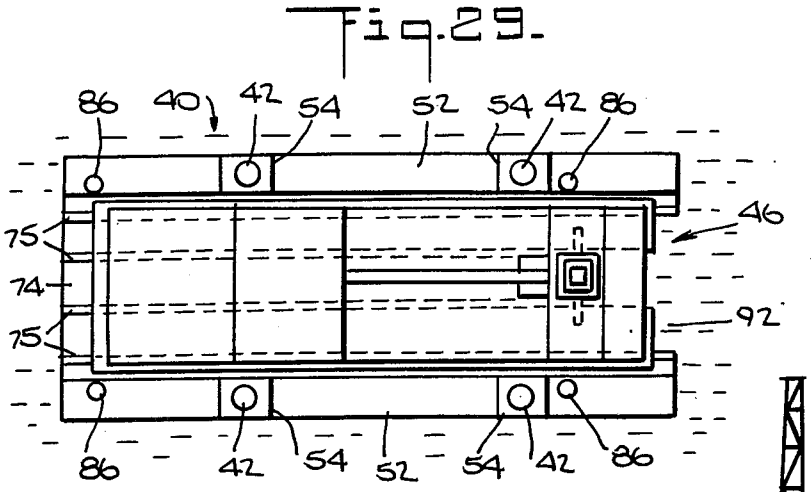
FIG. 29 is a plan view similar to FIG. 20 but showing the drilling mast of the shallow water drilling barge raised to operating position.
Figure 30:
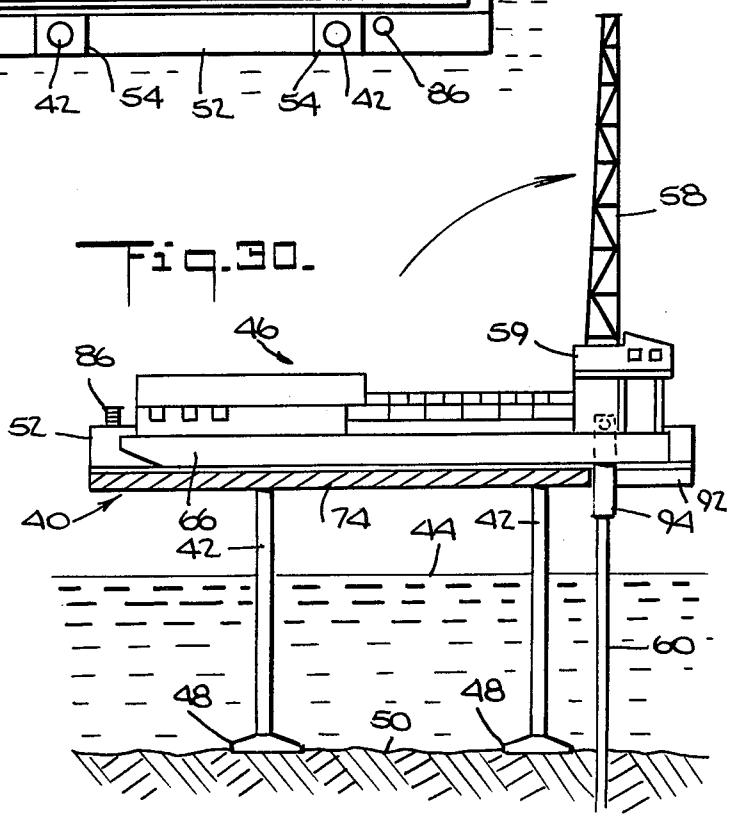
FIG. 30 is a side elevation view, partially in section, showing the jackup drydock and the shallow water drilling barge of FIG. 29.

When the shallow water drilling barge 46 has been positioned and locked in place, as above described, the mast 59 in raised, as shown in FIGS. 29 and 30, and drilling operations are commenced. From this point the shallow water drilling barge operates in the same manner that it does when carrying out a shallow water drilling operation.

Figure 33:
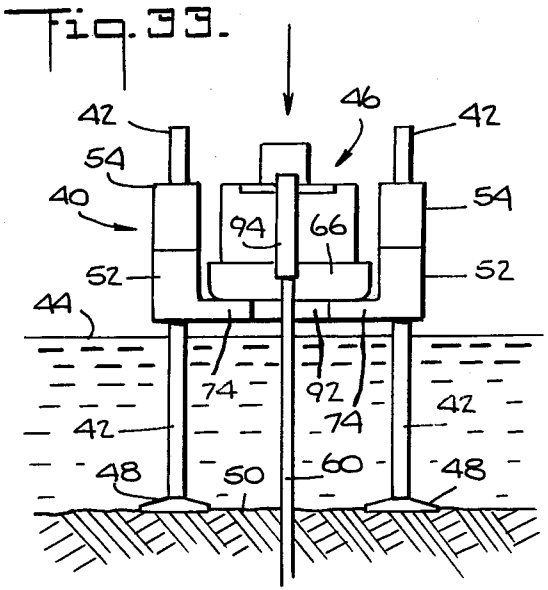
FIG. 33 is an end elevation view showing the lowering of the jackup drydock to return the shallow water drilling barge to the sea surface.
Figure 34:
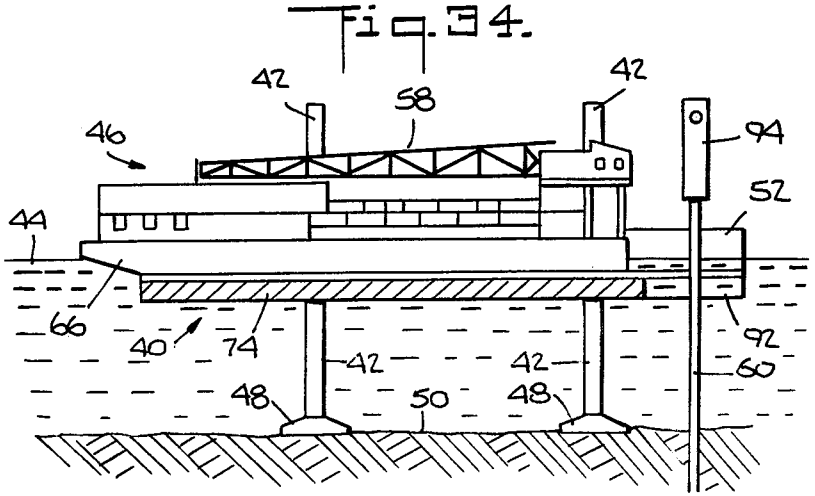
FIG. 34 is an side elevation view, partially in section, showing the lowered jackup drydock and shallow water drilling barge.
Figure 31:
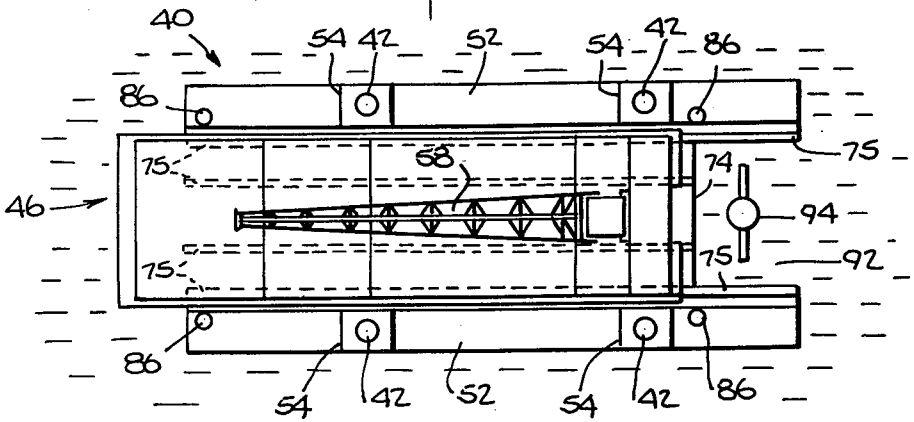
FIG. 31 is a plan view showing the shallow water drilling barge with its mast lowered and with the barge in a retracted position on the jackup drydock in preparation for lowering to the sea surface.
Figure 32:
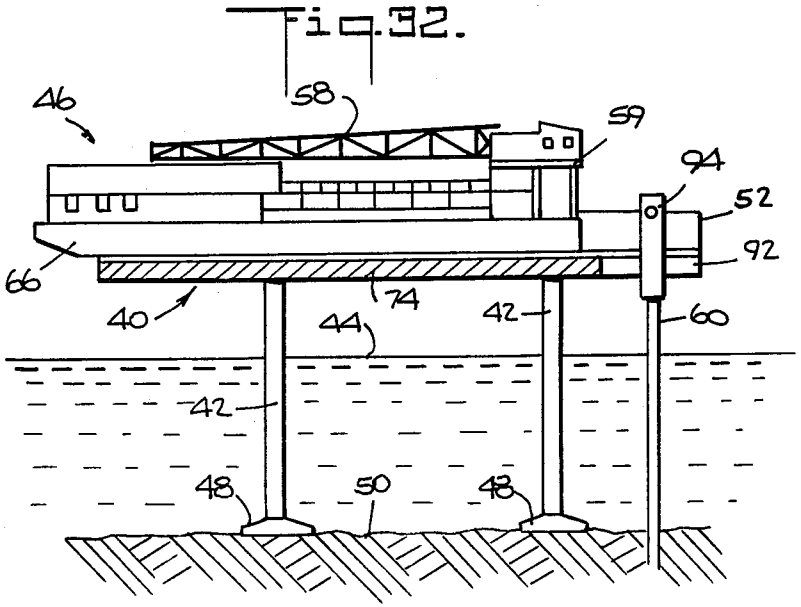
FIG. 32 is a side elevation view, partially in section, of the shallow water drilling barge and jackup drydock of FIG. 31.

Upon completion of drilling, the mast 59 of the shallow water drilling barge 46 is lowered and the barge is unlocked from the drydock platform 74 and is rolled back to its jacking position as shown in FIGS. 31 and 32. The jacking mechanisms of the jackup drydock are then operated to lower the barge-drydock assembly back down to the water as shown in FIGS. 33 and 34. During the jacking down operation the sea chest valves 56 of the jackup drydock 40 are opened to allow water to enter the wing walls 52 and the platform 74 so that the platform can be submerged to a level lower than the draft of the barge in its floating condition. Here also it is important to note that as the barge-drydock assembly is lowered into the water all of the water which floats the barge flows between the walls 52 from the ends of the horizontal platform 74 and only sufficient water to submerge the platform must flow through the sea chest valves 56. Thus the jacking down and floating of the shallow water drilling barge is carried out in an expeditious manner and with little or no uplift forces imposed upon the jacking legs 42 due to buoyant effects of the jackup drydock.

Figure 37:
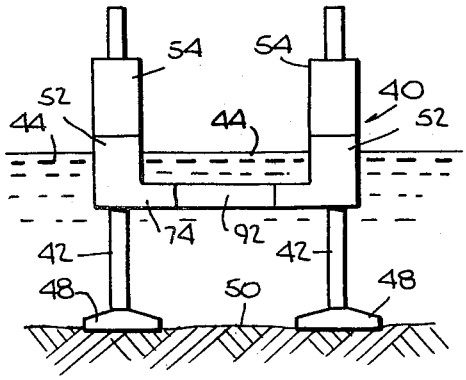
FIG. 37 is an end elevation view of the lowered jackup drydock of FIG. 36.
Figure 38:
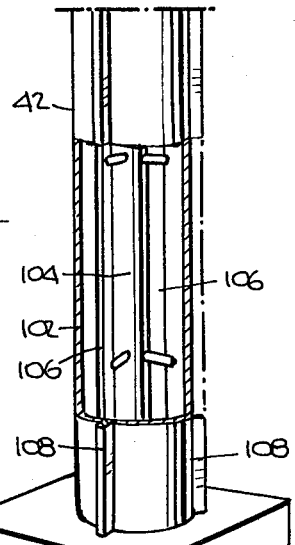
FIG. 38 is an end elevation view of the jackup drydock in floating condition with its legs elevated.
Figure 38:
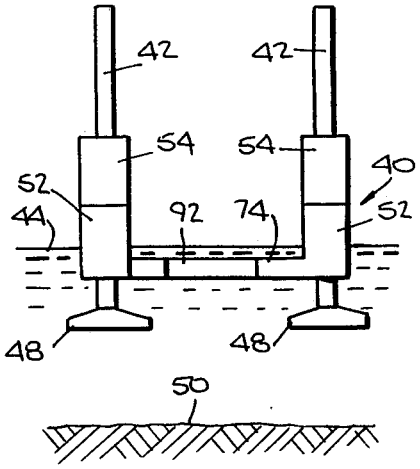
Figure 35:
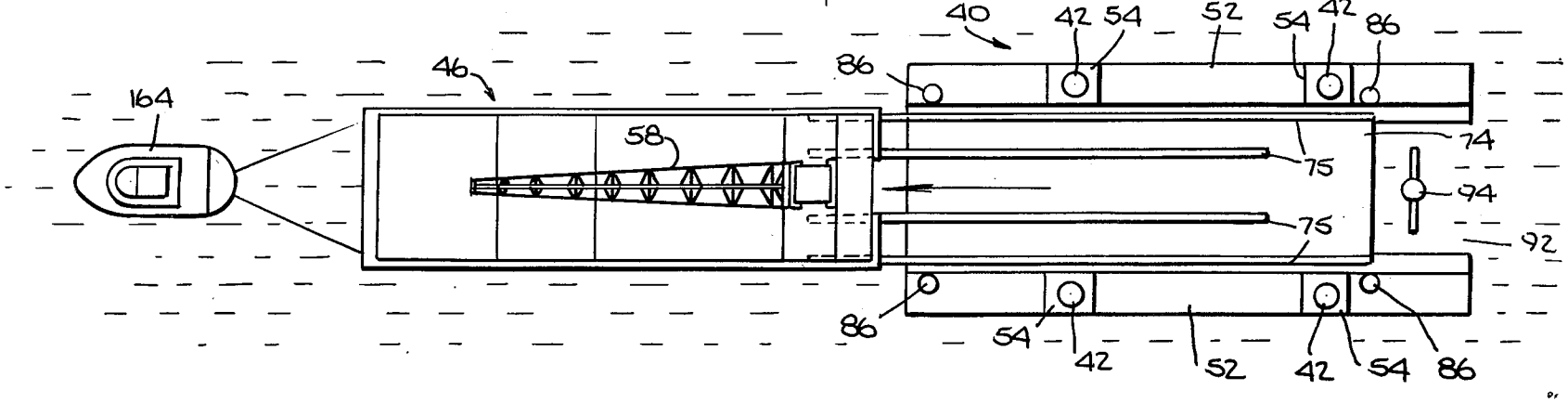
FIG. 35 is a plan view showing the shallow water drilling barge being floated away from the lowered jackup drydock.
Figure 36:
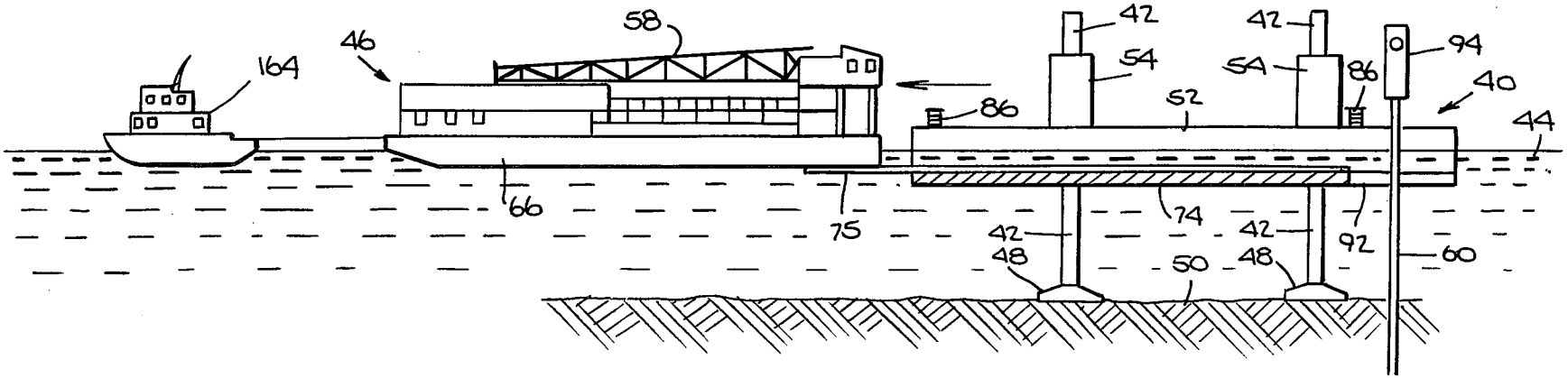
FIG. 36 is a side elevation view, partially in section, showing the shallow water drilling barge and jackup drydock of FIG. 35.

After the jackup drydock 40 has been lowered the barge 46 is towed away as shown in FIGS. 35 and 36. Following this the jackup drydock is raised to allow water to drain out through the sea chest valves 56 and the valves are closed. The jackup drydock is then lowered to a floating position as shown in FIG. 37 and the legs 42 are raised as shown in FIG. 38. The jackup drydock may then be towed to a new site for raising another shallow water drilling barge or for raising a production rig over a previously drilled well.

It will be seen from the foregoing that there has been described a novel and advantageous arrangement for permitting a shallow water barge to operate in a deep water location.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

I claim:

1. Apparatus for positioning a working barge in an elevated position above a sea surface, said apparatus comprising a pair of elongated buoyant wing walls having substantial freeboard, said wing walls being spaced apart and extending parallel to each other, a horizontal platform having essentially no freeboard and extending between and connected to said wing walls, a plurality of elongated support legs mounted to move up and down relative to said wing walls, jacking mechanisms mounted on said wing walls to move said legs up and down on said wing walls, said apparatus being floatable to a site of use and containing means for flooding said wing walls to change the buoyancy of said apparatus to partially submerge same and to permit same to be lowered in the water and to submerge said platform so that a working barge may be floated over the platform of said apparatus, said jacking mechanisms and said support legs being constructed and arranged to lift said wing walls and said platform from a first position at which said platform is submerged beneath the surface of the water to an elevated position at which both said platform and said wing walls are suspended above the surface of the water.

2. Apparatus according to claim 1 wherein said wing walls are hollow and are provided with valves communicating with their interior to control the flow of water into and out from their interior.

3. Apparatus according to claim 1 wherein said jacking legs extend through and are guided in said wing walls.

4. Apparatus according to claim 3 wherein said wing walls are provided with bulkheads to isolate the interiors of said wing walls from said jacking legs.

5. Apparatus according to claim 1 wherein said jacking mechanisms are mounted on said wing walls above the water level when said platform is submerged.

6. Apparatus according to claim 1 wherein said jacking mechanisms are mounted on top of said wing walls.

7. Apparatus according to claim 1 wherein said platform is formed with an opening at one end thereof to permit drilling and production operations to take place therethrough.

8. Apparatus according to claim 7 wherein said wing walls are provided with winches and cables connected thereto to move a working barge between a lifting position and a working position.

9. Apparatus according to claim 1 wherein said platform is provided with rollers to support a working barge.

10. Apparatus according to claim 9 wherein said rollers are arranged in rows extending fore and aft along said platform.

11. Apparatus according to claim 10 wherein said rollers are mounted on roller assemblies fixed to said platform.

12. Apparatus according to claim 11 wherein elongated rails are mounted to move along said rollers.

13. Apparatus according to claim 10 wherein said platform is formed with an opening at one end thereof to permit drilling and production operations to take place therethrough and wherein ramps are provided alongside said opening in line with said rows of rollers whereby said rails extend beyond said rollers and engage said ramp.

14. Apparatus according to claim 12 wherein said rails are provided with flanges which extend under lugs on said roller assemblies to maintain said rails on said roller assemblies.

15. In combination, a drydock having a pair of elongated buoyant wing walls extending parallel to each other and spaced apart from each other with a horizontal support platform extending between and interconnecting the wing walls near their lower edges, said wing walls having substantial freeboard and said horizontal platform having essentially no freeboard, said platform having an opening therein, a shallow water working barge supported on said platform between said wing walls and having working means above said opening and communicating through said opening, a plurality of jacking legs mounted to move up and down relative to said drydock, jacking mechanisms mounted on said drydock and connected to jack said drydock up along said legs and valves arranged in said wing walls to control the flow of water into and out from said wing walls said drydock being floatable to a site of use and being partially floodable via said valves to partially submerge said drydock to permit same to be lowered in the water and to submerge said platform so that said working barge may be floated over said platform, said jacking mechanisms and said support legs being constructed and arranged to lift said wing walls, said platform and said barge from a first position at which said platform is submerged beneath the barge floating in the water to an elevated position at which said platform, said barge and said wing walls are all suspended above the surface of the water.

16. A combination according to claim 15 wherein said jacking legs extend through and are guided in said wing walls.

17. A combination according to claim 16 wherein said wing walls are provided with bulkheads to isolate the interior of said wing walls from said jacking legs.

18. A combination according to claim 15 wherein said jacking mechanisms are mounted on said wing walls above the water level when said platform is submerged by an amount sufficient to allow said barge to be floated over said platform.

19. A combination according to claim 15 wherein said jacking mechanisms are mounted above said wing walls.

20. A combination according to claim 15 wherein said wing walls are provided with winches and cables connected between said winches and said barge to move said barge along said platform.

21. A combination according to claim 15 wherein said barge is supported by rollers on said platform.

22. A combination according to claim 21 wherein said rollers are arranged in rows extending fore and aft along said platform.

23. A combination according to claim 22 wherein said rollers are mounted on roller assemblies fixed to said platform.

24. A combination according to claim 21 or 23 wherein elongated rails are mounted to move along said rollers and wherein said barge rests on said rails.

25. A combination according to claim 24 wherein the portion of said barge which extends over said platform alongside said opening is supported by elevated portions of said platform.

26. A combination according to claim 25 wherein said elevated portions are in the form of ramps extending in the path of said rails.

27. A combination according to claim 21 wherein said platform and said barge are provided with locking means for securing said barge from fore and aft movement along said platform.

28. A combination according to claim 27 wherein said locking means comprises a first flange extending from a lower edge of said barge and a second flange parallel to the first flange and extending from said platform and means for locking said flanges together.

29. A combination according to claim 27 wherein said locking means comprises a railing extending along and spaced apart from the lower edge of said barge and a plurality of hangar elements bolted to said platform, said hangar elements having hook-like upper ends which extend over said railing and means for securing said hook-like upper ends to said railing.

30. A method of positioning a working barge in an elevated position above a sea surface, said method comprising the steps of floating a drydock, comprising a pair of elongated variable buoyancy wing walls of substantial freeboard interconnected along their lower edges by a horizontal platform of essentially no freeboard, to an offshore location, said drydock being floatable by virtue of the buoyancy of its wing walls, lowering a plurality of legs from said drydock to the sea bottom, decreasing the buoyancy of said wing walls by partially flooding same to partially submerge said wings walls and fully submerge said platform by an amount sufficient to permit said working barge to be floated over the platform, floating said working barge into position over the submerged platform between said wing walls and jacking said drydock up out of the water to raise said barge to said elevated position.

31. A method according to claim 30 wherein, prior to the step of floating said drilling or production barge over said platform, said drydock is jacked up on said legs out of the water and the weight of the raised drydock is transferred to different ones of said legs to preload them and settle them into the sea bed.

32. A method according to claim 30 wherein the buoyancy of said wing walls is decreased by opening valves near the bottom of said wing walls to allow water to flow into the interior thereof.

33. A method according to claim 32 wherein said valves are maintained open during the jacking of said drydock up out of the water whereby water contained in the wing walls will flow out therefrom.

* * * * *

UNITED STATES PATENT AND TRADEMARK OFFICE

CERTIFICATE OF CORRECTION

PATENT NO. : 4,456,404

DATED : June 26, 1984

INVENTOR(S) : DARRELL L. EVANS

It is certified that error appears in the above-identified patent and that said Letters Patent is hereby corrected as shown below:

ABSTRACT, line 11, change "or" to --on--.
Column 2, line 25, delete "the one aspect of" and substitute --one aspect of the--.
Column 3, line 51, begin new paragraph with "FIG. 21".
Column 4, line 23, change "an" to --a--.
Column 5, line 13, change "know" to --known--;
line 19, change "flotatable" to --floatatable--.
Column 9, line 25, change "describe" to --described--.

Signed and Sealed this

*Twenty-sixth* Day of *February 1985*

[SEAL]

*Attest:*

DONALD J. QUIGG

*Attesting Officer*

*Acting Commissioner of Patents and Trademarks*